US006621381B1

(12) United States Patent
Kundu et al.

(10) Patent No.: US 6,621,381 B1
(45) Date of Patent: Sep. 16, 2003

(54) TEM-MODE DIELECTRIC RESONATOR AND BANDPASS FILTER USING THE RESONATOR

(75) Inventors: Arun Chandra Kundu, Tokyo (JP); Kenji Endou, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/716,204

(22) Filed: Nov. 21, 2000

(30) Foreign Application Priority Data

| | | |
|---|---|---|
| Jan. 21, 2000 | (JP) | 2000-012939 |
| Jan. 21, 2000 | (JP) | 2000-012940 |
| Mar. 13, 2000 | (JP) | 2000-068554 |

(51) Int. Cl.[7] ..... H01P 1/20
(52) U.S. Cl. ..... 333/202; 333/206
(58) Field of Search ..... 333/202, 206, 333/210

(56) References Cited

U.S. PATENT DOCUMENTS

| | | | | |
|---|---|---|---|---|
| 4,837,535 A | * | 6/1989 | Konishi et al. | 333/206 |
| 5,010,309 A | * | 4/1991 | Manssen et al. | 333/202 |
| 5,929,725 A | * | 7/1999 | Toda et al. | 333/202 |

OTHER PUBLICATIONS

Proceedings of the IEEE, vol. 79, No. 6, pp. 197–211; Jun. 1991.
IEICE Transactions on Electronics, vol. E82–C, No. 2, pp. 393–402; Feb. 1999.
IEEE Transactions on Microwave Theory and Techniques, vol. MTT–22, No. 10, pp. 857–864; Oct. 1974.
Int. J. Electronics, vol. 37, No. 5, pp. 689–703, 1974.
IEEE Transactions on Microwave Theory and Techniques, pp. 636–639; Oct. 1973.
IEEE Transactions on Microwave Theory and Techniques, pp. 664–665; Jul. 1971.
IEEE Transactions on Microwave Theory and Techniques, vol. MTT–19, No. 7, pp. 643–652; Jul. 1971.
Microstrip Lines for Microwave Integrated Circuits, The Bell System Technical Journal, pp. 1421–1444; May–Jun. 1969.
Kundu et al., "Low–Profile Dual–Mode BPF Using Square Dielectric Resonator", *Proceedings of the 1997 Chugoku–region Autumn Joint Conference of Electric/Information Associated Congress*, Hiroshima, Japan, Oct. 1997, p. 272.
Kundu et al., "Distributed Coupling In A Circular Dielectric Disk Resonator And Its Application To A Square Dielectric Disk Resonator To Fabricate A Low–Profile Dual–Mode BPF", *1998 IEEE MIT–S Digest*, Maryland, USA, Jun. 1998, pp. 837–840.

* cited by examiner

*Primary Examiner*—Robert Pascal
*Assistant Examiner*—Joseph Chang
(74) *Attorney, Agent, or Firm*—Armstrong, Westerman & Hattori, LLP

(57) ABSTRACT

A TEM mode λ/4 dielectric resonator includes a rectangular dielectric block having a top planar surface, a bottom planar surface and four side surfaces, a first metal layer coated on the top planar surface, a second metal layer coated on the bottom planar surface, and a third metal layer coated on one of the four side surfaces.

48 Claims, 37 Drawing Sheets

TEM-MODE DIELECTRIC RESONATOR AND BANDPASS FILTER USING THE RESONATOR

FIELD OF THE INVENTION

The present invention relates to a low-profile TEM mode (dominant mode) quarter wavelength ($\lambda/4$) dielectric resonator having a high unloaded quality factor compared to a conventional dielectric resonator, and to a two-pole bandpass filter using this low-profile TEM mode dielectric resonator.

In the two-pole bandpass filter according to the present invention, the coupling between two adjacent resonators is provided by evanescent mode waveguide.

A resonator according to the present invention is expected to be used in a filter, a voltage controlled oscillator (VCO) and an antenna for mobile communication. A filter of the present invention can be used in a cellular phone system such as wide band CDMA (Code Division Multiple Access), and another communication system where filtering is required.

DESCRIPTION OF THE RELATED ART

The followings are known literatures:

[1] Arun Chandra Kundu and Ikuo Awai, "Low-Profile Dual Mode BPF Using Square Dielectric Disk Resonator," Proceedings of the 1997 Chugoku-region Autumn Joint Conference of Electric/Information Associated Congress, Hiroshima, Japan, pp. 272 (October, 1997).

[2] Arun Chandra Kundu and Ikuo Awai, "Distributed Coupling in a Circular Dielectric Disk Resonator and its Application to a Square Dielectric Disk Resonator to Fabricate a Low-Profile Dual Mode BPF". 1998 IEEE MTT-S Digest, pp. 837–840, June 1998, Maryland, USA

[3] Yoshihiro Konishi, "Novel Dielectric Waveguide Components—Microwave Application of New Ceramic Materials," IEEE Proc., Vol. 79, No. 6, pp. 726–740, June, 1991.

In the literatures [1] and [2], Arun Chandra Kundu who is one of inventors of the present application has proposed a new type TEM dual-mode dielectric disk resonator having the following configuration, and a bandpass filter (BPF) using the resonator.

This dielectric resonator is a dual mode resonator having a square planer shape in 5 mm×5 mm, and its top and bottom surfaces are covered with silver. The top silver layer is floating, and the bottom silver layer is grounded. The interior of the two silver layers are filled with dielectric material of a relative permittivity or relative dielectric constant of 93. All of the side walls of the disk resonator are open surfaces exposed to the air. Accordingly, radiation easily occurs with leakage of electromagnetic field through these open surfaces. An electric field becomes at the maximum on each open surface, and becomes at the minimum along each symmetry plane of the resonator. Therefore this kind of resonator is called a half wavelength ($\lambda/2$) dielectric disk resonator.

FIG. 1 illustrates the result of a theoretically and experimentally verifying relationship between the thickness and the unloaded quality factor $Q_0$ regarding this disk resonator, and a similar graph is described in the literature [1]. As apparent from the figure, the unloaded quality factor $Q_0$ becomes at the maximum (≈250 (experimental value)) when the thickness is 1 mm and the length and the width of the resonator is 5 mm×5 mm using dielectric material with a relative dielectric constant of 93.

Recent mobile terminals demand super compact bandpass filter, and hence it is required to promote further low profiling and compacting of dielectric resonators used inside the portable terminals. However, it is very difficult except that material having a higher dielectric constant is used in order to further miniaturize the dielectric resonator with keeping high performance.

In addition, if a 2 GHz bandpass filter is formed with using the conventional resonator described in the literature [2], the size of the filter become 8.5 mm×8.5 mm×1.0 mm, and its unloaded quality factor becomes 260. The recent mobile terminals, however, demand more compact and higher-performance filters.

SUMMARY OF THE INVENTION

It is therefore an object of the present invention to provide a TEM mode dielectric resonator having a minimized size without changing a resonant frequency and an unloaded quality factor.

Another object of the present invention is to provide a bandpass filter using a TEM mode dielectric resonator, whereby the size can be minimized with keeping the performance of the filter.

According to the present invention, a TEM mode $\lambda/4$ dielectric resonator includes a rectangular dielectric block having a top planar surface, a bottom planar surface and four side surfaces, a first metal layer coated on the top planar surface, a second metal layer coated on the bottom planar surface, and a third metal layer coated on one of the four side surfaces.

FIG. 2 illustrates the configuration of a conventional $\lambda/2$ dielectric resonator, and FIG. 3 illustrates the fundamental configuration of a $\lambda/4$ dielectric resonator according to the present invention.

In FIG. 2, reference numeral 20 denotes a dielectric block with a rectangular planar shape, 21 a silver layer coated on a top surface of the dielectric block 20, and 22 a silver layer coated on a bottom surface of the dielectric block 20. The top silver layer 21 is floating, and the bottom silver layer 22 is grounded. All of the four sidewalls of the dielectric block 20 are open to the air. In FIG. 2, the length and width of the $\lambda/2$ dielectric resonator is denoted by "a" and its thickness is denoted by "t".

Supposing that the TEM mode propagating along z-axis direction in this $\lambda/2$ dielectric resonator, the negative maximum electrical field exists on a plane at Z=0 and the positive maximum electrical field on a plane at z=a, as shown by arrows 23 in FIG. 2. The minimum (zero) electrical field obviously exists on a plane 24 at z=a/2 that is the symmetry plane of the $\lambda/2$ resonator.

It is possible to obtain two $\lambda/4$ dielectric resonators by dividing such $\lambda/2$ dielectric resonator. along this symmetry plane 24 and providing conductors on the divided surfaces.

FIG. 3 illustrates a $\lambda/4$ dielectric resonator formed in this manner. In the figure, reference numeral 30 denotes a dielectric block with a rectangular parallelepiped shape, 31 a silver layer coated on a top surface of the dielectric block 30, and 32 a silver layer coated on a bottom surface of the dielectric block 30. The top silver layer 31 is floating, and the bottom silver layer 32 is grounded. One of side walls of the dielectric block 30 is a shorted end surface of a silver-coated layer 34 for shorting the top and bottom silver layers 31 and 32, and other three side walls are open to the air. In FIG. 3, also, arrows 33 denote a direction of an electrical field, and arrows 35 a direction of current.

The λ/4 dielectric resonator shown in FIG. 3 and the λ/2 dielectric resonator shown in FIG. 2 have the same resonant frequency in principle. Due to a high relative dielectric constant of 93, electromagnetic field confinement property is strong enough. Thus, the electromagnetic field distribution of the λ/4 resonator and λ/2 resonator is almost the same. As shown in FIGS. 2 and 3, the volume of the λ/4 resonator is half as that of the λ/2 resonator. In consequence, a total energy of the λ/4 resonator is half as that of the λ/2 resonator. Nevertheless, an unloaded quality factor of the λ/4 resonator remains almost the same as that of the λ/2 resonator since the energy loss decreases to 50% as that of the λ/2 resonator. Accordingly, it is possible to drastically miniaturize the λ/4 dielectric resonator without changing the resonant frequency and also the unloaded quality factor.

It is preferred that the rectangular dielectric block of the above-mentioned dielectric resonator is made of a ceramic dielectric material.

It is preferred that the resonator further includes a metal pattern partially formed on the one side surface that is different from the side surface on which the third metal layer is coated. The metal pattern may be formed on the side surface opposite to the side surface on which the third metal layer is coated, or on the side surface perpendicular to the side surface on which the third metal layer is coated.

The metal pattern has preferably a substantially rectangular shape. However, its shape is not limited to the rectangular shape, but it is possible to have an optional shape.

It is preferred that the metal pattern is an excitation electrode of the resonator. It is also preferred that the metal pattern is isolated from the first metal layer coated on the top planar surface and from the second metal layer coated on the bottom planar surface.

It is further preferred that the metal pattern has dimensions suitable for external circuit coupling.

Preferably, the resonator further includes an extension part extended from the metal pattern for control of external quality factor. This extension part is provided on the bottom planar surface.

It is preferred that the first metal layer on the top planar surface has a narrow slit for frequency tuning. It is more preferred that this slit is formed along a direction different from the direction of mode propagation.

The TEM mode dielectric resonator according to the present invention will be applied to not only a filter but also a voltage controlled oscillator (VCO) and an antenna.

According to the present invention, furthermore, a bandpass filter using a TEM mode dielectric resonator is provided. This filter includes first and second dielectric resonators each including a dielectric block having a top planar surface, a bottom planar surface, and four side surfaces, and an evanescent H-mode waveguide coupling section. Each of the first and second dielectric resonators has first and second metal layers coated on the top planar surface and the bottom planar surface, respectively, and a third metal layer coated on one of the four side surfaces. The side surface on which the third metal layer is coated is a shorted end surface and the remaining side surfaces are open to the air so that each of the first and second dielectric resonators acts as a quarter wavelength dielectric resonator and keeps an independent TEM mode of electromagnetic field. The evanescent H-mode waveguide coupling section provides TEM mode coupling between the first and second dielectric resonators by connecting the shorted end surfaces of the respective first and second dielectric resonators so as to act in an evanescent mode with a cutoff frequency higher than each resonant frequency of the first and second dielectric resonators.

As aforementioned, by using TEM dual mode half wavelength configuration in order to form a dual mode filter, dimensions of the fabricated 2 GHz filter become 8.5 mm×8.5 mm×1.0 mm. According to the present invention, dimensions are optimized in 3.0 mm×4.25 mm×1.0 mm by adopting a TEM mode λ/4 dielectric resonator. By using two of such λ/4 dielectric resonators, a two-pole bandpass filter is formed. Owing to this, dimensions of the filter become 3.0 mm×9.0 mm×1.0 mm. Thus, the volume of the bandpass filter according to the present invention becomes one-third of that of the conventional bandpass filter. Besides, the performance of the filter according to the present invention is excellent.

Two-pole and multi-pole filters each using an adequate number of λ/4 resonators are described in the literature [3]. However, it should be noted that these filters are TE mode dielectric waveguide resonator filters.

Although such TE mode dielectric waveguide resonator filters have superior in performance, dimensions and volume in comparison with the conventional cavity filter, recent small and lightweight mobile terminals demand much miniaturized and high performance filters. Hence, in the present invention, by using TEM mode λ/4 dielectric resonators, a two-pole bandpass filter is formed. The resonant frequency of the dominant TE mode resonator varies depending upon the change in its length and its thickness, whereas the resonant frequency of the TEM mode resonator is independent to the change in its thickness. Hence, according to the present invention, it is possible to optimize the thickness of the resonator as a function of an unloaded quality factor at a specific resonant frequency. Therefore, according to the present invention, a further miniaturized and advanced performance bandpass filter in comparison with the conventional bandpass filter can be provided.

It is preferred that the first and second dielectric resonators are made of the same dielectric material. It is more preferred that these first and second dielectric resonators are made of ceramic dielectric material with a high dielectric constant. Preferably, the evanescent mode waveguide coupling section is made of the same dielectric material with the first and second dielectric resonators.

It is also preferred that the first and second dielectric resonators have the almost same dimensions.

It is preferred that the evanescent H-mode waveguide coupling section has a shorter length and a smaller cross section than these of each of the first and second dielectric resonators. It is more preferred that dimensions of the evanescent H-mode waveguide coupling section are selected so as to obtain a desired coupling between the first and second dielectric resonators.

It is also preferred that the evanescent H-mode waveguide coupling section has a rectangular cross section.

It is preferred that the evanescent H-mode waveguide coupling section provides series coupling inductance and a pair of shunt coupling inductances between the first and second dielectric resonators.

It is preferred that the second metal layer coated on each of the bottom planar surfaces of the first and the second dielectric resonators is used as a ground plane. More preferably, the ground plane is extended to the two open side surfaces in each of the first and second dielectric resonators.

It is preferred that the side surface opposite to or perpendicular to the shorted end surface of each of the first and second dielectric resonators has an electrical input/output port. This electrical input/output port may be a metal pattern with a rectangular, square, trapezoidal or circular shape.

It is preferred that the metal pattern is isolated from the first metal layer coated on the top planar surface and from the second metal layer coated on the bottom planar surface. It is also separated from the third metal layer.

It is also preferred that the first metal layer coated on the top planar surface of at least one of the first and second dielectric resonators has a narrow slit for frequency tuning. The slit may be formed along a direction different from mode propagation direction.

According to the present invention, another bandpass filter using a TEM mode dielectric resonator is provided. This filter includes first and second dielectric resonators each including a dielectric block having a top planar surface, a bottom planar surface and four side surfaces, and an evanescent E-mode waveguide coupling section. Each of the first and second dielectric resonators has first and second metal layers coated on the top planar surface and the bottom planar surface, respectively, and a third metal layer coated on one of the four side surfaces. The side surface on which the third metal layer is coated is a shorted end surface and the remaining side surfaces are open to the air so that each of the first and second dielectric resonators acts as a quarter wavelength dielectric resonator and keeps an independent TEM mode of electromagnetic field. The evanescent E-mode waveguide coupling section provides TEM mode coupling between the first and second dielectric resonators by connecting the open side surfaces opposite to the shorted end surfaces of the respective first and second dielectric resonators so as to act in an evanescent E-mode with a cutoff frequency higher than each resonant frequency of the first and second dielectric resonators. The two resonators are coupled by the evanescent E-mode waveguide between the open side surfaces of the respective resonators.

The volume of the bandpass filter according to the present invention is one-third of that of the conventional bandpass filter. Besides, the performance of the filter according to the present invention is excellent.

It is preferred that the evanescent E-mode waveguide coupling section has a top planar surface being open to the air, four side surfaces being open to the air and a bottom planar surface on which a metal layer is coated.

It is very preferred that the bandpass filter has attenuation poles at both sides of a passband thereof. Since the bandpass filter of the present invention has unintentional attenuation poles at both sides of the passband, the frequency characteristic outside the passband can be improved. Thus, the bandpass filter can further enhance the frequency characteristic around the slope of the passband. Concretely, this bandpass filter is configured so that one of internal coupling between the first and second dielectric resonators via the evanescent E-mode waveguide coupling section is capacitive coupling and that the other one of the direct coupling is inductive coupling.

It is preferred that the first and second dielectric resonators are made of the same dielectric material. Preferably, the first and second dielectric resonators are made of ceramic dielectric material with a high dielectric constant. More preferably, the evanescent E-mode waveguide coupling section is made of the same dielectric material with the first and second dielectric resonators.

It is preferred that the first and second dielectric resonators have the almost same dimensions.

It is preferred that the evanescent E-mode waveguide coupling section has a shorter length and a smaller cross section than these of each of the first and second dielectric resonators. It is more preferred that dimensions of the evanescent E-mode waveguide coupling section are selected so as to obtain a desired coupling between the first and second dielectric resonators.

It is also preferred that the evanescent E-mode waveguide coupling section has a rectangular cross section.

It is preferred that the evanescent E-mode waveguide coupling section provides series capacitance and a pair of shunt capacitances between the first and second dielectric resonators.

It is preferred that the second metal layer coated on each of the bottom planar surfaces of the first and the second dielectric resonators is used as a ground plane. It is also preferred that the bottom planar surface on which the metal layer is coated, of the evanescent E-mode waveguide coupling section is used as a ground plane.

It is preferred that the side surface perpendicular to the shorted end surface of each of the first and second dielectric resonators is used for capacitive excitation. This excitation will be performed by an electrical input/output port formed on this side surface perpendicular to the shorted end surface of each of the first and second dielectric resonators.

Preferably, the electrical input/output port is formed by a metal pattern with a rectangular, square, trapezoidal or circular shape.

It is preferred that the metal pattern is isolated from the first metal layer coated on the top planar surface and from the second metal layer coated on the bottom planar surface.

It is also preferred that the metal pattern has dimensions selected so as to obtain a desired external circuit coupling.

It is preferred that the first metal layer on the top planar surface of at least one of the first and second dielectric resonators has a narrow slit for frequency tuning.

Further objects and advantages of the present invention will be apparent from the following description of the preferred embodiments of the invention as illustrated in the accompanying drawings.

DESCRIPTION OF THE PREFERRED EMBODIMENTS

First Embodiment of Quarter Wavelength Dielectric Resonator

Figure 4A:
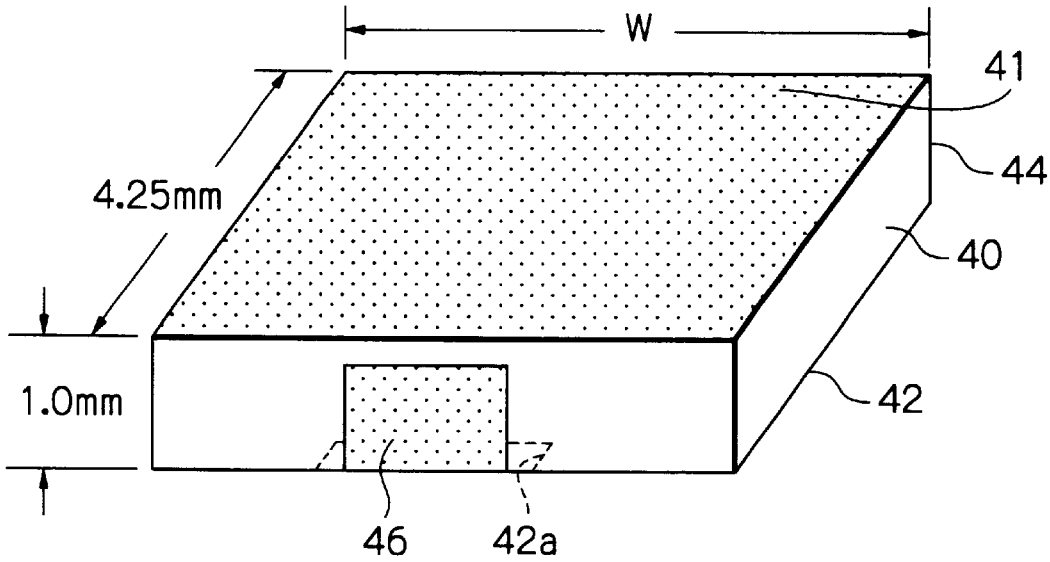
FIG. 4*a* is a perspective view schematically illustrating the configuration of a dielectric resonator, as a first preferred embodiment of the $\lambda/4$ dielectric resonator according to the present invention.
Figure 4B:
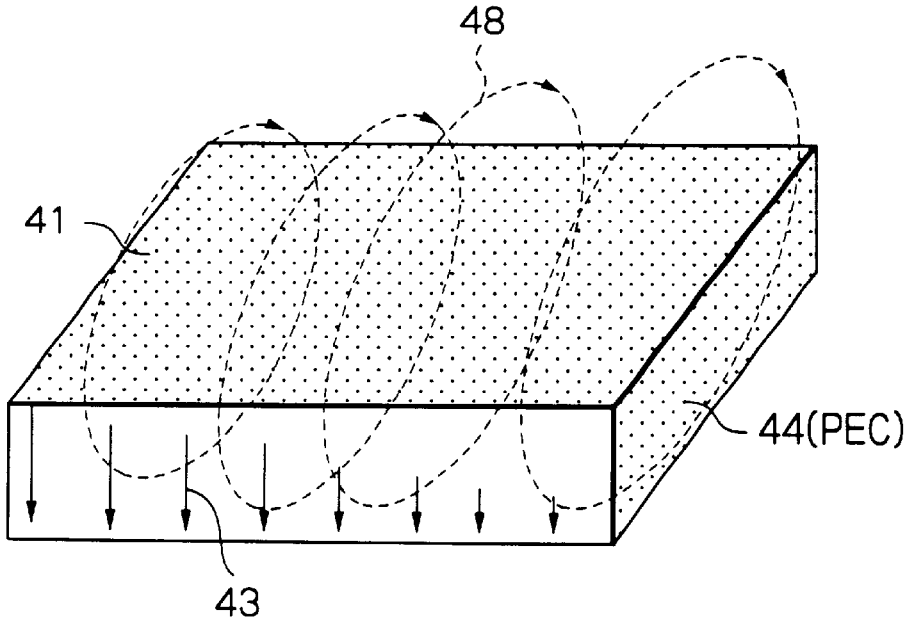
FIG. 4*b* is a perspective view explaining the linkage of magnetic fields on a PEC (perfect electric conductor) plane in the embodiment of FIG. 4*a;*

FIG. 4*a* schematically illustrates the configuration of a λ/4 dielectric resonator as a first preferred embodiment of the λ/4 dielectric resonator according to the present invention, and FIG. 4*b* explains the linkage of magnetic fields on a PEC plane in this embodiment.

In FIG. 4*a,* reference numeral 40 denotes a dielectric block with a rectangular planar shape, 41 a metal layer coated on a top surface of the dielectric block 40, and 42 a metal layer coated on a bottom surface of the dielectric block 40. The metal layer 42 on the bottom surface is grounded. A metal layer 44 on one of side walls corresponds to the PEC of a λ/2 resonator and short-circuits the top metal layer 41 and the bottom metal layer 42, and other three of the side walls is open to the air. An excitation electrode 46 of an approximately rectangular metal pattern is formed on the side wall of the dielectric block 40 opposite to the side wall coated by the metal layer 44. A cutout 42 a to isolate the excitation electrode 46 from the bottom ground metal layer 42 is provided in part of this metal layer 42.

In this embodiment, the dielectric block 40 is formed with dielectric material having a comparatively high relative dielectric constant of 93, and the metal layers 41, 42 and 44, and the excitation electrode 46 are made of silver.

Resonant Frequency

The theoretical concept for calculating a resonant frequency described in the literature [2] can be applied to a rectangular planer shaped dielectric resonator of this embodiment. Hereinafter, the dielectric resonator having a resonant frequency around 2 GHz will be discussed.

According to the theory described in this literature [2], the dimensions of a λ/2 dielectric resonator is 8.5 mm×8.5 mm×1.0 mm at the resonant frequency of 2 GHz. This value was verified experimentally.

As already described with reference to FIGS. 2 and 3, by dividing this λ/2 dielectric resonator along its symmetry plane in a direction of propagation (z axis), two λ/4 dielectric resonators can be obtained. Dimensions of each of the two λ/4 resonators becomes 8.5 mm×4.25 mm×1.0 mm. Each of the λ/4 resonator has one shorted. end surface coated with the metal layer 44 as described above. In case of the λ/2 dielectric resonator, the symmetry plane operates as an imaginary electric wall. However, in case that two real λ/4 dielectric resonators are formed from the single λ/2 dielectric resonator, each of these imaginary electric walls becomes a wall coated with the metal layer 44 as shown in FIGS. 4*a* and 4*b*.

As shown in FIG. 4*b,* the magnetic fields 48 in the λ/4 dielectric resonator become the maximum on the shorted end surface coated by this metal layer 44. The magnetic fields 48 give an effect of additional series inductance to a resonant frequency by linking the metal layer 44. Therefore, the resonant frequency of the λ/4 resonator becomes a little lower than that of the λ/2 resonator. In FIG. 4*b,* reference numeral 43 denotes electrical fields.

As a result, the λ/4 dielectric resonator of this embodiment can get two advantages to reduce its dimensions simultaneously. One comes from the concept of the λ/4 dielectric resonator and the other one is derived from the frequency drop by the shorted end surface 44 of the λ/4 resonator in comparison with the case of the λ/2 resonator.

An experimental resonant frequency of the λ/4 dielectric resonator with the size of 8.5 mm×4.25 mm×1.0 mm is 1.945 GHz. This is lower by 55 MHz than the resonant frequency of the λ/2 dielectric resonator with the size of 8.5 mm×8.5 mm×1.0 mm.

Unloaded Quality Factor

A numerical value for evaluating the performance or quality of a resonator is a quality factor. An unloaded quality factor $Q_0$ is defined as:

$$Q_0=\omega_0 x \text{ (energy stored in the resonant circuit)/(power loss in the resonant circuit)},$$

where $\omega_0$ is an angular resonant frequency.

Figure 2:
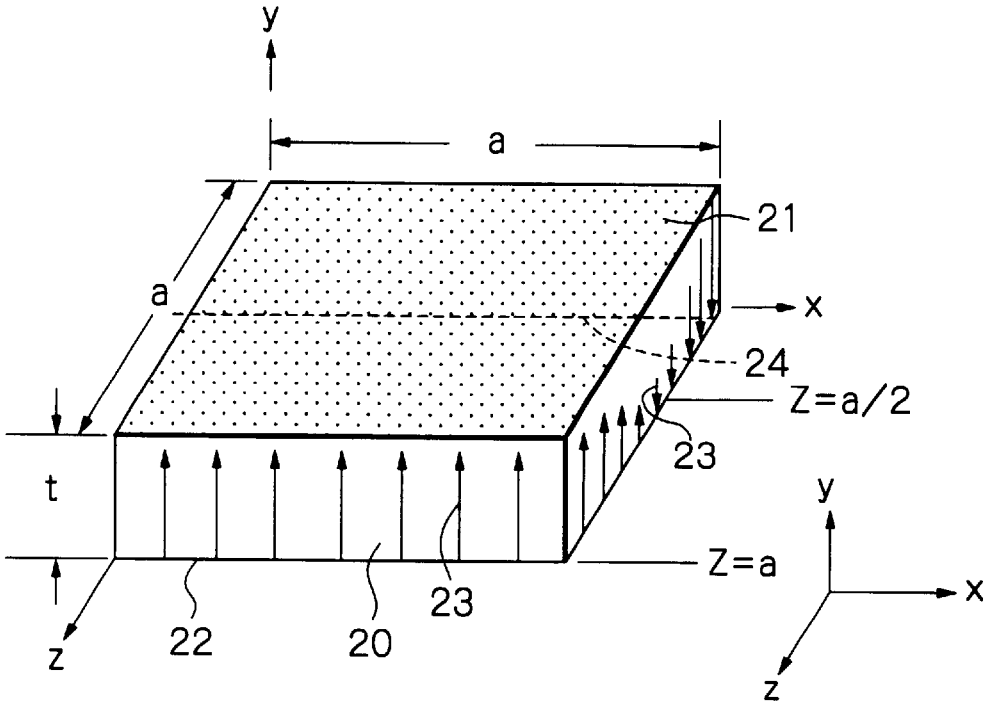
Fig. 2 PRIOR ART
FIG. 2 already described is a perspective view illustrating the configuration of a conventional $\lambda/2$ dielectric resonator.

The λ/2 dielectric resonator shown in FIG. 2 has three loss factors, conductor loss by metal coating, dielectric loss by dielectric material, and radiation loss by opening of the dielectric material to the air.

The unloaded quality factor $Q_0$ of the λ/2 dielectric resonator can be calculated using the following equation:

$$1/Q_0=1/Q_c+1/Q_d+1/Q_r,$$

where $Q_c$ is a quality factor based on the conductor loss, $Q_d$ is quality factor based on the dielectric loss, and $Q_r$ is a quality factor based on the radiation loss.

Because the quality factor is inversely proportional to the loss, the larger this quality factor is, the less power loss is.

The dielectric quality factor ($Q_d$)×resonant frequency (GHz)=A (constant), where A is a loss factor of dielectric material and independent to a frequency for certain frequency range. According to the applicant's measurement, A=7500 GHz, for the frequency range of 2–10 GHz and for a dielectric material with a relative dielectric constant of 93.

As discussed above, the resonant frequency of the λ/4 dielectric resonator is slightly lower than that of the λ/2 dielectric resonator, and thus the dielectric quality factor $Q_d$ of λ/4 resonator will be slightly increased.

Figure 3:
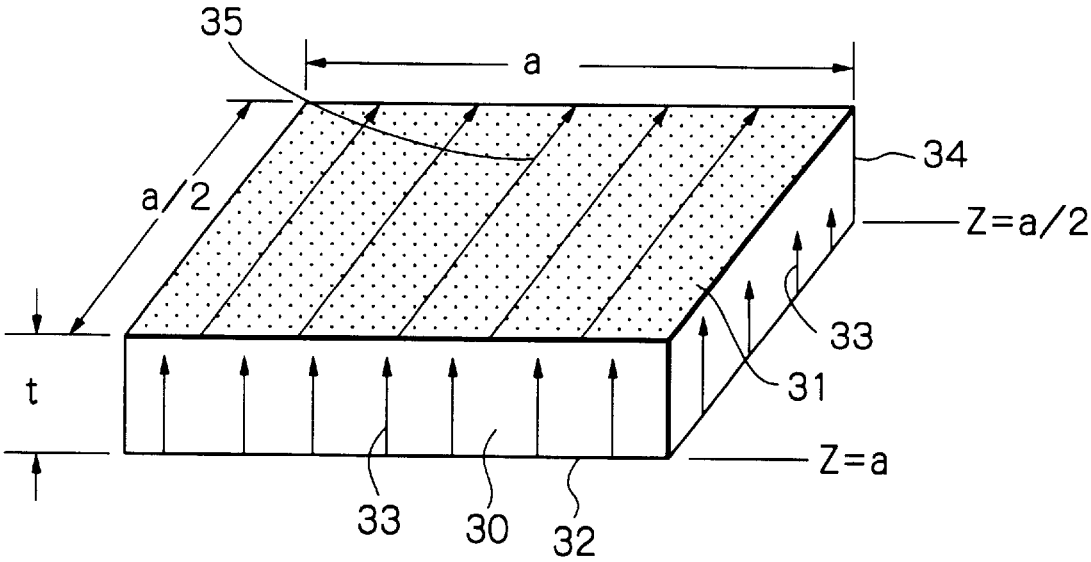
FIG. 3 already described is a perspective view illustrating the fundamental configuration of a $\lambda/4$ dielectric resonator according to the present invention.

As apparent from FIGS. 2 and 3, an area of the open surface of the λ/4 resonator is half of that of the λ/2 resonator. Accordingly, the radiation loss also becomes almost half.

In the λ/4 resonator, the conductor loss also becomes almost half because an area of metal coating (except a plane of the PEC) becomes half.

Only the additional loss source in the λ/4 dielectric resonator is the PEC plane. This plane is small and this loss is compensated partly by the dielectric loss.

The volume of the λ/4 dielectric resonator is half of that of the λ/2 dielectric resonator and the loss factors are almost half, respectively. Thus, the unloaded quality factors of the λ/4 resonator and of the λ/2 resonator are almost the same.

An experimentally obtained unloaded quality factor of the λ/2 dielectric resonator with the size of 8.5 mm×8.5 mm×1.0 mm is 260, whereas the unloaded quality factor of the λ/4 dielectric resonator with the size of 8.5 mm×4.25 mm×1.0 mm is 250. This minute difference is caused by the conductor loss in the PEC plane.

As mentioned above, the volume of the λ/4 dielectric resonator is half of that of the λ/2 dielectric resonator, but the resonant frequency and the unloaded quality factor that are two important parameters for the resonator are almost the same.

Optimization of the Resonator Dimensions

The resonant frequency of the lowest mode (TEM mode) of the λ/4 dielectric resonator according to this embodiment is mainly dependent on the length of the resonator ($w<\lambda g/2$, where λg is a wavelength in the resonator), it has little dependence on its width W. In case of a resonant frequency of 1.945 GHz, the length of the λ/4 resonator is 4.25 mm, and this is almost constant. The thickness of the λ/2 resonator in this embodiment is optimized at 1.00 mm as described in the literature [1].

Accordingly only one left parameter to optimize the dimension of the λ/4 resonator is a width w of this resonator.

Figure 5A:
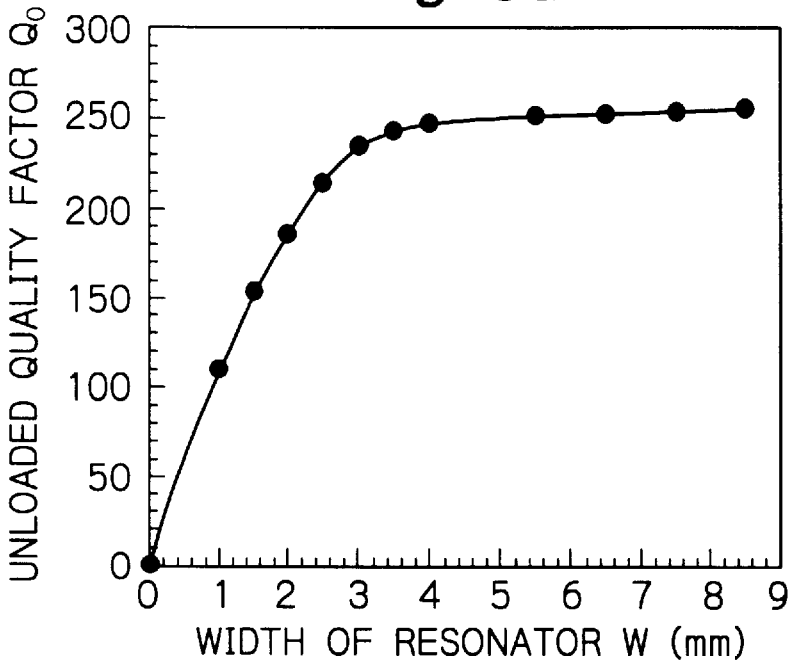
FIG. 5*a* is a graph of an unloaded quality factor $Q_0$ versus a width w of a resonator.

FIG. 5*a* illustrates the characteristic of the unloaded quality factor $Q_0$ versus the width w of the λ/4 dielectric resonator.

As will be seen from FIG. 5*a,* the unloaded quality factor is sharply increasing to W=3.0 mm, and after that it remains almost constant. Accordingly, W=3.0 mm, i.e. the dimensions of 3.0 mm×4.25 mm×1.0 mm is the optimum dimensions of the TEM mode λ/4 dielectric resonator with the unloaded quality factor of $Q_0 \approx 240$. If w>3.0 mm, the internal energy of the resonator is almost proportional to the loss of this resonator, and hence, the unloaded quality factor does not increase. This λ/4 resonator is very effective if it is used for a filter in a mobile communication system for example.

Because an area of the PEC decreases by the reduction of the resonator width, additional magnetic field leakage decreases. Accordingly, the series inductance decreases causing the resonant frequency to rise.

From the experimental result, when the width of the λ/4 resonator decreased from w=8.5 mm to 3.0 with maintaining the length and the thickness of the resonator at 4.25 mm and 1.00 mm respectively, the resonant frequency in the TEM mode rose from 1.945 GHz to 2.133 GHz.

Figure 5B:
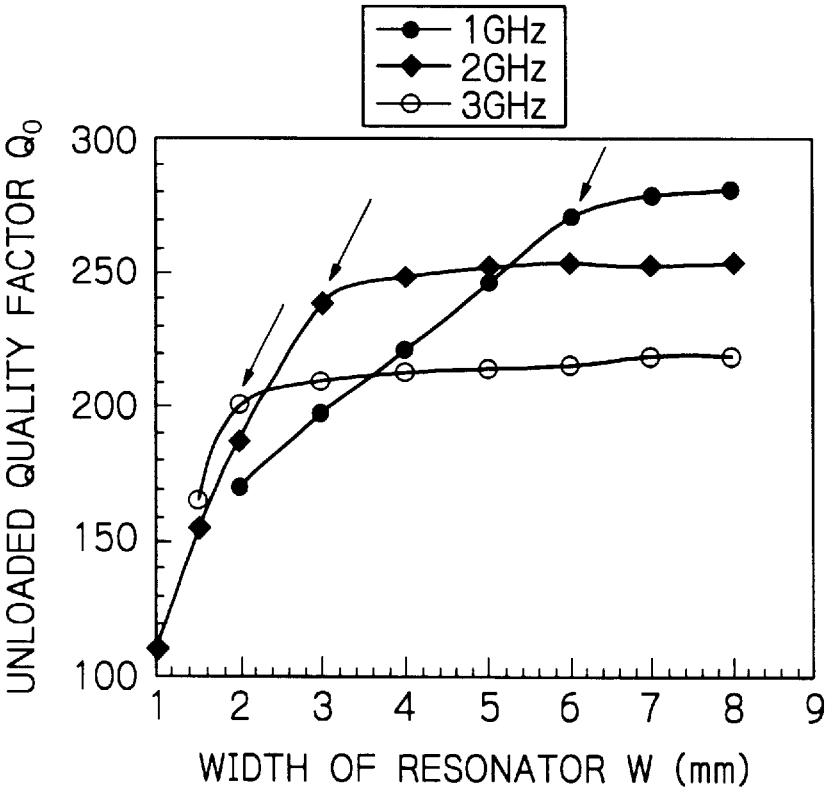
FIG. 5*b* is a graph of an unloaded quality factor $Q_0$ versus a width w of a resonator, for optimization of the resonator width at 1, 2 and 3 GHz resonant frequencies.

Similarly, as shown in FIG. 5*b,* the width of the resonator at each resonant frequency of 1 GHz, 2 GHz and 3 GHz was optimized. The optimum width was w≈6 mm in 1 GHz, w≈3 mm in 2 GHz, and w≈2 mm in 3 GHz. If other parameters of the resonator such as the thickness of the resonator and the dielectric constant are kept constant and the resonant frequency doubles, the optimum width of the resonator will become half.

Second Embodiment of Quarter Wavelength Dielectric Resonator

Figure 6:
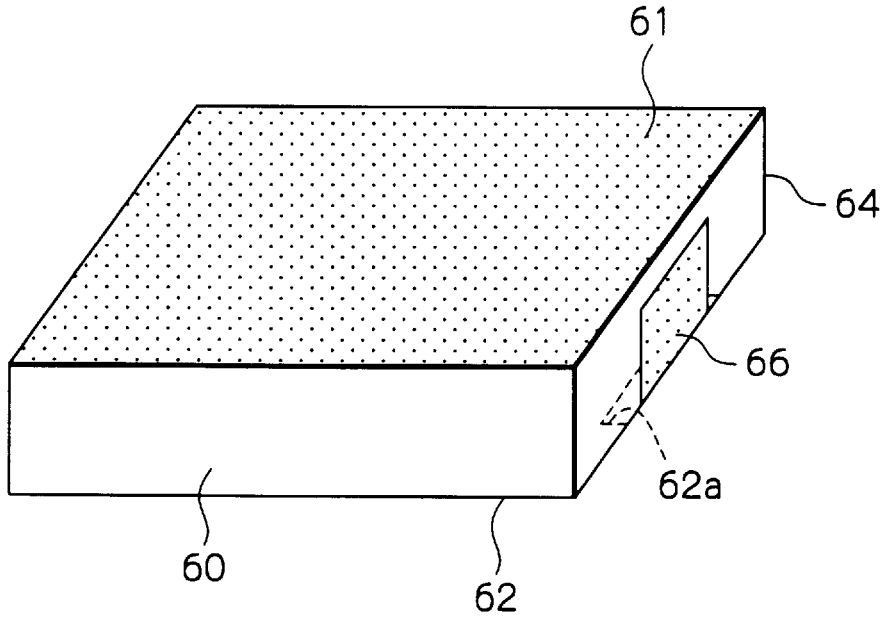
FIG. 6 is a perspective view schematically illustrating the configuration of a $\lambda/4$ dielectric resonator, as a second embodiment of the λ/4 dielectric resonator according to the present invention.

FIG. 6 schematically illustrates the configuration of the λ/4 dielectric resonator as a second embodiment of the λ/4 dielectric resonator according to the present invention.

In FIG. 6, reference numeral 60 denotes a dielectric block with a rectangular planar shape, 61 a metal layer coated on a top surface of the dielectric block 60, and 62 a metal layer coated on a bottom surface of the dielectric block 60. The metal layer 62 on the bottom surface is grounded. A metal layer 64 on one of side walls corresponds to the PEC of a λ/2 resonator and short-circuits the top metal layer 61 and the bottom metal layer 62, and other three of the side walls is open to the air. An excitation electrode 66 of an approximately rectangular metal pattern is formed on the side wall of the dielectric block 60 orthogonal to the side wall coated by the metal layer 64. A cutout 62*a* to isolate the excitation electrode 66 from the bottom ground metal layer 62 is provided in part of this metal layer 62.

In this embodiment, the dielectric block 60 is formed with dielectric material having a comparatively high relative dielectric constant of 93, and the metal layers 61, 62 and 64, and the excitation electrode 66 are made of silver.

The configuration of this embodiment is the same as that of the embodiment in FIG. 4*a* except that the excitation electrode 66 is provided on the side wall orthogonal to the shorted end surface, and operations and advantages of this embodiment are almost similar to those in the embodiment in FIG. 4*a*.

Third Embodiment of Quarter Wavelength Dielectric Resonator

Figure 7:
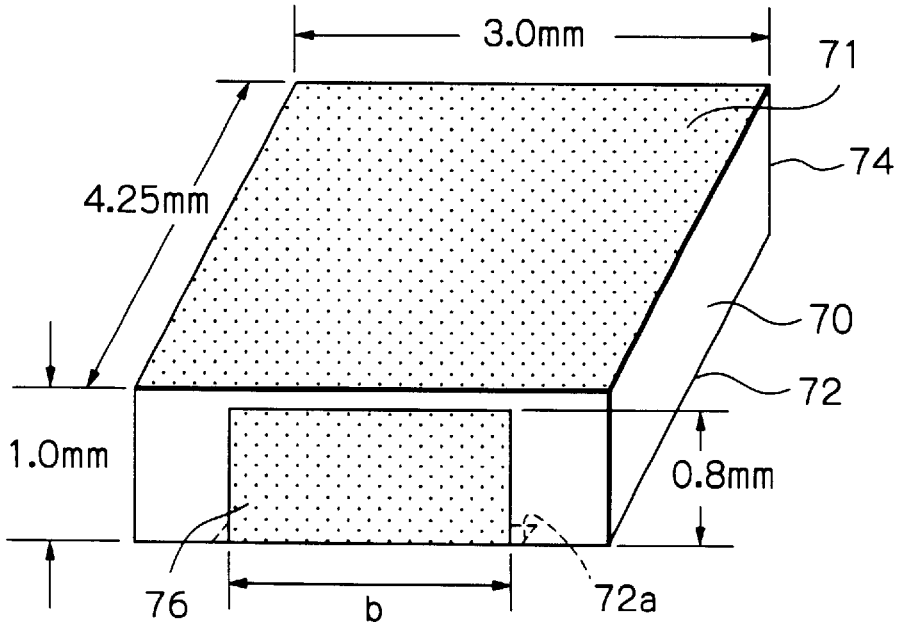
FIG. 7 is a perspective view schematically illustrating the configuration of a λ/4 dielectric resonator, as a third embodiment of the λ/4 dielectric resonator according to the present invention.

FIG. 7 schematically illustrates the configuration of the λ/4 dielectric resonator as a third embodiment of the λ/4 dielectric resonator according to the present invention.

In FIG. 7, reference numeral 70 denotes a dielectric block with a rectangular planar shape, 71 a metal layer coated on a top surface of the dielectric block 70, and 72 a metal layer coated on a bottom surface of the dielectric block 70. The metal layer 72 on the bottom surface is grounded. A metal layer 74 on one of side walls corresponds to the PEC of a λ/2 resonator and short-circuits the top metal layer 71 and the bottom metal layer 72, and other three of the side walls is open to the air. An excitation electrode 76 of an approximately rectangular metal pattern is formed on the side wall of the dielectric block 70 opposite to the side wall coated by the metal layer 74. A cutout 72 a to isolate the excitation electrode 76 from the bottom ground metal layer 72 is provided in part of this metal layer 72.

In this embodiment, the dielectric block 70 is formed with dielectric material having a comparatively high relative dielectric constant of 93, and the metal layers 71, 72 and 74, and the excitation electrode 76 are made of silver.

Control of External Quality Factor

An external quality factor can be controlled by changing the dimensions of the excitation electrode 76. In this embodiment, the dimensions of the excitation electrode 76 are set to optimum values for controlling the external quality factor.

Figure 8:
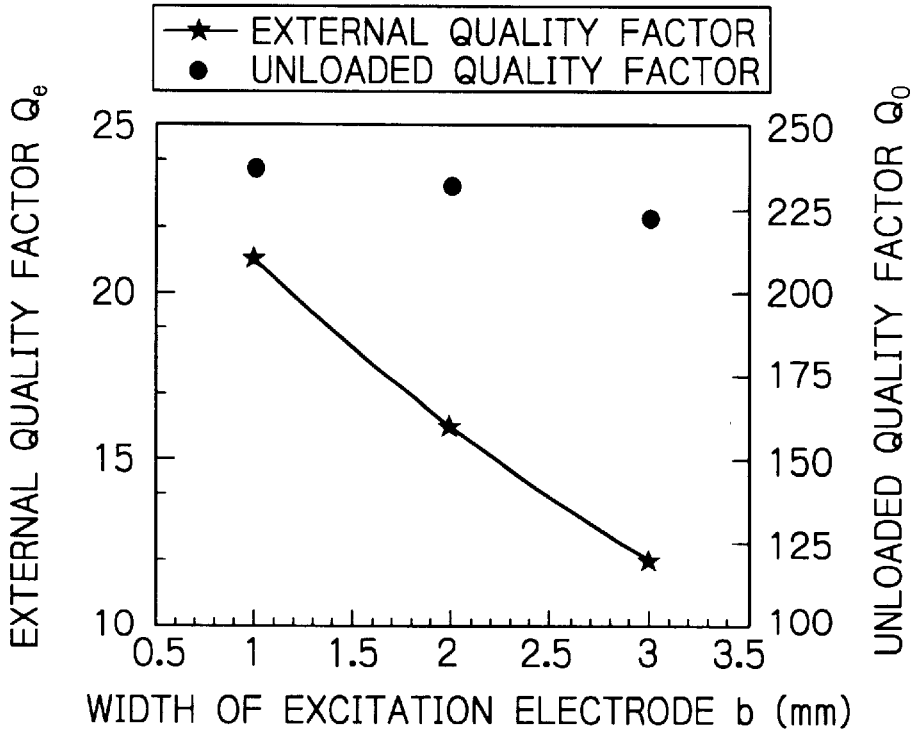
FIG. 8 is a graph illustrating changes of an external quality factor and an unloaded quality factor versus changes of a width b of an excitation electrode in the embodiment of FIG. 7.

FIG. 8 illustrates the characteristic of changes of the external quality factor and unloaded quality factor versus changes of the width b of the excitation electrode 76 in this embodiment.

If the width b is increased while maintaining the height of the excitation electrode 76 at a constant value of 0.8 mm, capacitance offered by this excitation electrode 76 increases with the increase of the width b. Accordingly, the external circuit coupling will increase. As a result, the external quality factor decreases as shown in FIG. 8. This change of the external quality factor will provide no significant effects on the unloaded quality factor $Q_0$ as shown in FIG. 8.

Figure 9:
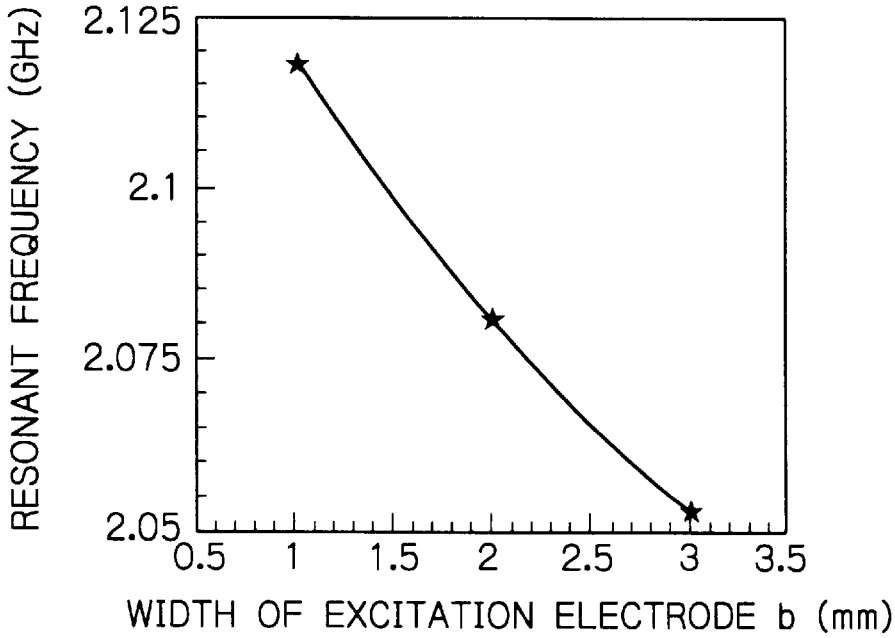
FIG. 9 is a graph illustrating changes of a resonant frequency versus changes of the width b of the excitation electrode in the embodiment of FIG. 7.

FIG. 9 illustrates the characteristic of changes of the resonant frequency versus changes of the width b of the excitation electrode 76 in this embodiment.

Capacitance of the excitation electrode 76 causes a decrease of the resonant frequency. Hence, as shown in FIG. 9, as the width b of the excitation electrode 76 increases, that is, capacitance of the excitation electrode 76 increases, the resonant frequency decreases. This assists the miniaturization of the resonators especially for wide band applications. Nevertheless, the change of the resonant frequency is quiet small because the excitation electrode capacitance is considerably small in comparison with the resonator capacitance.

The configuration of this embodiment is the same as the configuration of the embodiment in FIG. 4*a* except that the dimensions of the excitation electrode 76 are optimized to control the external quality factor. Other operations and advantages of this embodiment are almost similar to those in the embodiment in FIG. 4*a*.

Fourth Embodiment of Quarter Wavelength Dielectric Resonator

Figure 10A:
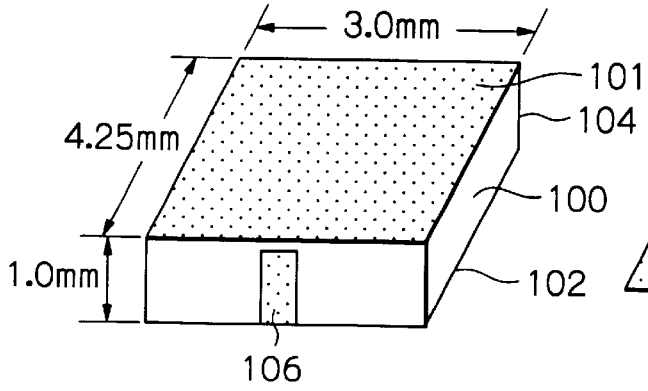
FIG. 10*a* is a perspective view schematically illustrating the configuration of a λ/4 dielectric resonator, as a fourth embodiment of the λ/4 dielectric resonator according to the present invention, with viewing from the top of the resonator.
Figure 10B:
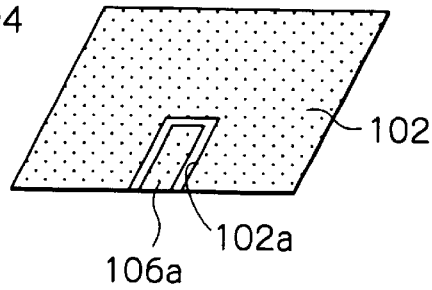
FIG. 10*b* is a perspective view schematically illustrating only the bottom surface of the resonator in the embodiment of FIG. 10*a;*

FIG. 10*a* schematically illustrates the configuration of a λ/4 dielectric resonator, as a fourth embodiment of the λ/4 dielectric resonator according to the present invention, with viewing from the top of the resonator, and FIG. 10*b* schematically illustrates only the bottom surface of the resonator in the embodiment of FIG. 10*a*.

In the figures, reference numeral 100 denotes a dielectric block with a rectangular planar shape, 101 a metal layer coated on a top surface of the dielectric block 100, and 102 a metal layer coated on a bottom surface of the dielectric block 100. The metal layer 102 on the bottom surface is grounded. A metal layer 104 on one of side walls corresponds to the PEC of a λ/2 resonator and short-circuits the top metal layer 101 and the bottom metal layer 102, and other three of the side walls is open to the air. An excitation electrode 106 of an approximately rectangular metal pattern is formed on the side wall of the dielectric block 100 opposite to the side wall coated by the metal layer 104. A cutout 102*a* to isolate the excitation electrode 106 from the bottom ground metal layer 102 is provided in part of this metal layer 102. It is experimentally verified that the external quality factor can be controlled even by widening the excitation electrode 106 to the grounded plane as shown in FIG. 10*b*.

In th is embodiment, the dielectric block 100 is formed with dielectric material having a comparatively high relative dielectric constant of 93, and the metal layers 101, 102 and 104, and the excitation electrode 106 are made of silver.

In this embodiment, the dielectric block 100 is formed with dielectric material having a comparatively high dielectric constant 93, and metal layers 101 and 102, and the excitation electrode 106 and the extension 106*a* thereof are formed with silver.

The configuration of this embodiment is the same as that of the embodiment in FIG. 4*a* except that the extension 106*a* of the excitation electrode 106 is provided on the bottom surface. Other operations and advantages of this embodiment are almost similar to those in the embodiment in FIG. 4*a*.

Fifth Embodiment of Quarter Wavelength Dielectric Resonator

Figure 11:
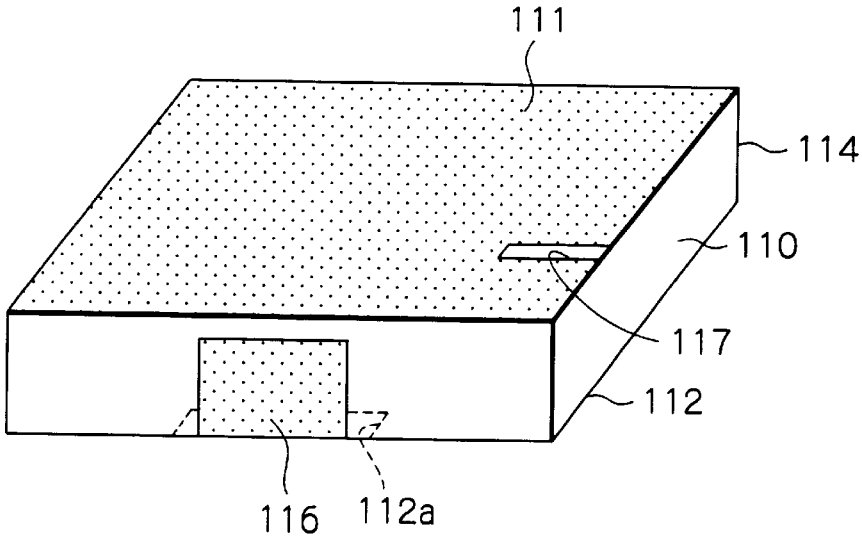
FIG. 11 is a perspective view schematically illustrating the configuration of a λ/4 dielectric resonator, as a fifth embodiment of the λ/4 dielectric resonator according to the present invention.
Figure 12:
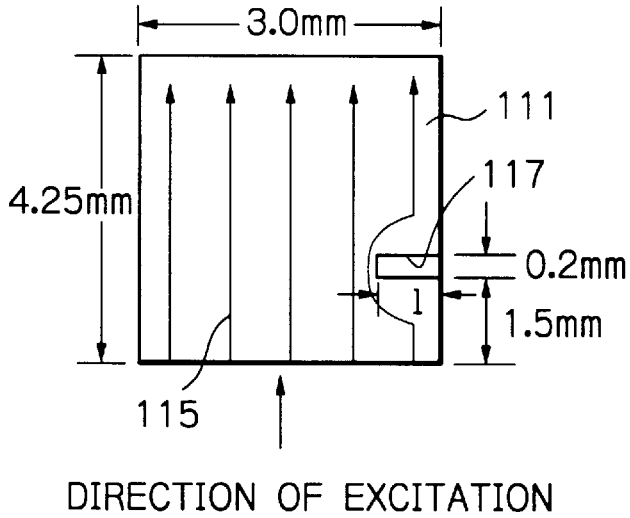
FIG. 12 is a top view illustrating the top surface of the dielectric resonator in the embodiment of FIG. 11.

FIG. 11 schematically illustrates the configuration of the λ/4 dielectric resonator as a fifth embodiment of the λ/4 dielectric resonator according to the present invention, and FIG. 12 illustrates the top surface of the dielectric resonator in the embodiment of FIG. 11.

In the figures, reference numeral 110 denotes a dielectric block with a rectangular planar shape, 111 a metal layer coated on a top surface of the dielectric block 110, and 112 a metal layer coated on a bottom surface of the dielectric block 110. The metal layer 112 on the bottom surface is grounded. A metal layer 114 on one of side walls corresponds to the PEC of a λ/2 resonator and short-circuits the top metal layer 111 and the bottom metal layer 112, and other three of the side walls is open to the air. An excitation electrode 116 of an approximately rectangular metal pattern is formed on the side wall of the dielectric block 110 opposite to the side wall coated by the metal layer 114. A cutout 112*a* to isolate the excitation electrode 116 from the bottom ground metal layer 112 is provided in part of this metal layer 112.

A slit 117 is provided in the metal layer 111 coated on the top surface. In this embodiment, this slit 117 consists of a narrow slit with a width of nearly 0.2 mm for example and extends in a direction perpendicular to the direction of current flow 115 as shown in FIG. 12.

In this embodiment, the dielectric block 110 is formed with dielectric material having a comparatively high relative dielectric constant of 93, and the metal layers 111, 112 and 114, and the excitation electrode 116 are made of silver.

Frequency Tuning

As shown in FIG. 12, the slit 117 along the orthogonal direction to the excitation direction partially prevents the current 115 through the metal layer 111 of the resonator from flowing. Since this narrow slit 117 acts as the series inductance for the resonator, the resonant frequency becomes low as the length 1 of the slit 117 becomes long. In this embodiment, radiation through this slit 117 can be reduced because its width is made to be remarkably small, that is, nearly 0.2 mm.

Figure 13:
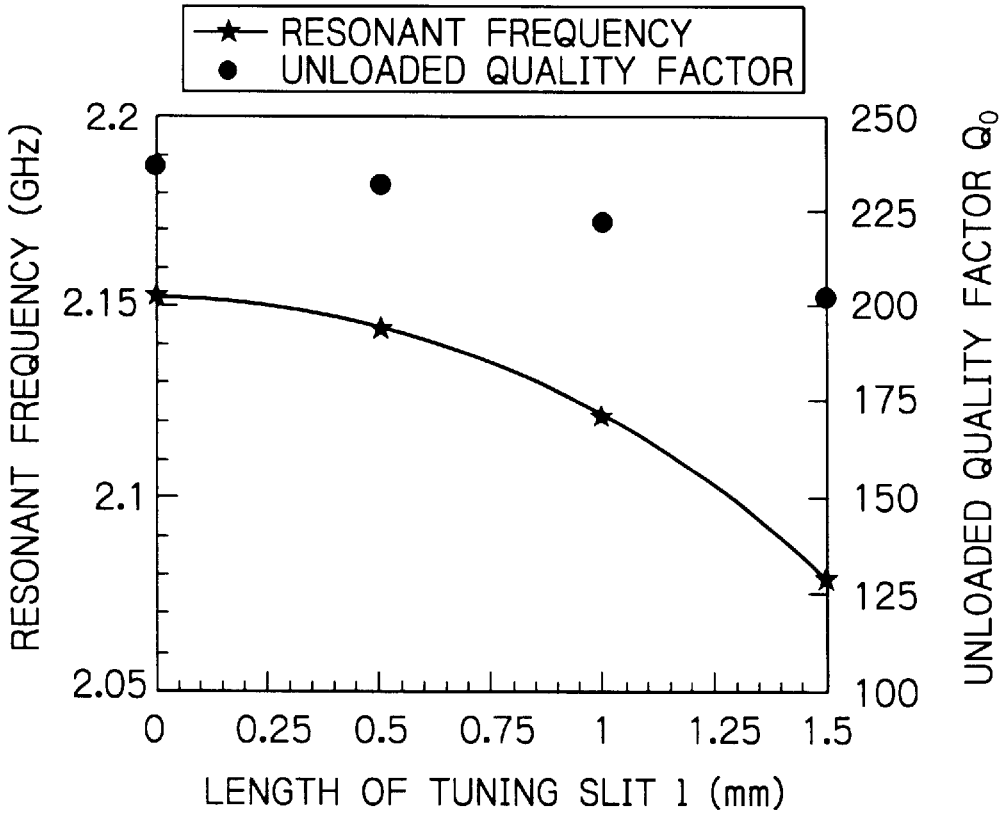
FIG. 13 is a graph illustrating a resonant frequency and an unloaded quality factor versus a length of a slit for frequency tuning in the embodiment of FIG. 11.

FIG. 13 illustrates the characteristic of the resonant frequency and unloaded quality factor versus the length of the frequency-tuning slit.

From the experimental result as shown in the figure, the resonant frequency falls from 2.152 GHz to 2.079 GHz as the length 1 of the slit 117 (length along the orthogonal direction to the excitation direction) changes from 0.0 mm to 1.5 mm. The conductor loss increases by the interruption of current flow, and the unloaded quality factor slightly reduces as the length 1 of the slit 117 increases.

This frequency-tuning slit can be located on any position including a central section and a periphery of the top metal layer 111. The extending direction of the slit can be any direction so long as this direction is different from the excitation direction. Also, a plurality of slits may be provided in the top metal layer.

The configuration of this embodiment is the same as that of the embodiment in FIG. 4*a* except that the slit 117 is provided in the metal layer 111. Other operations and advantages of this embodiment are almost similar to those in the embodiment in FIG. 4*a*.

Spurious Mode

Figure 14:
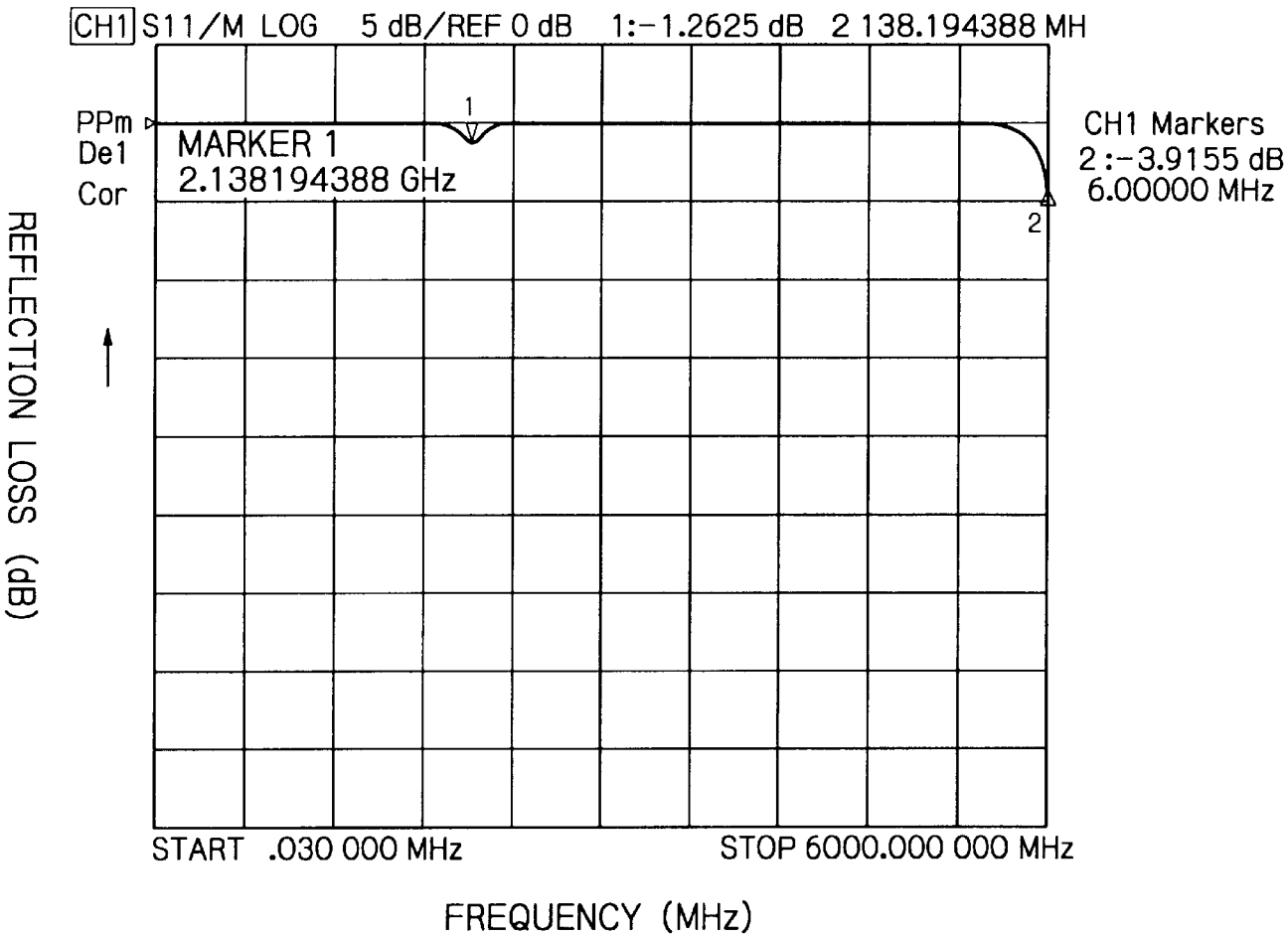
FIG. 14 is a graph obtained by actually measuring a frequency characteristic of reflection loss of a λ/4 dielectric resonator of the above-mentioned embodiment.

FIG. 14 illustrates an actually measured frequency characteristic of reflection loss in the λ/4 dielectric resonator of the above-mentioned embodiment. As apparent from the figure, the spurious mode of this resonator exists at 6.0 GHz apart by nearly 3.9 GHz from the dominant mode or the mode used. Accordingly, the dominant mode is entirely free from the effect of spurious mode.

Applications of Resonator

Application to a voltage controlled oscillator (VCO) of the above-mentioned dielectric resonator according to the present invention will be explained first.

The performance of a VCO, that is, a carrier-to-noise (C/N) ratio is dependent on an unloaded quality factor of a dielectric resonator used. A recent VCO used for a mobile communication terminal demands an ultra thin resonator with a high unloaded quality factor in order to improve the C/N of the VCO. The conventional dielectric resonator for the VCO utilizes a part of a printed circuit board, namely the metal layer with a thickness of about 0.16 mm on the printed circuit board. Also, the conventional dielectric resonator is coated with 0.2 mm-thick insulating material. Thus, the total thickness of the conventional resonator becomes 0.36 mm. The unloaded quality factor of such the resonator with the dimensions of 2.0 mm×4.25 mm×0.36 mm is only 20 at 2 GHz.

Whereas, if a λ/4 dielectric resonator is formed to have the dimensions of 2.0 mm×4.25 mm×0.36 mm at 2 GHz according to the present invention, the unloaded quality factor will become 120. This is 6 times as large as that of the conventional dielectric resonator. In the dielectric resonator in the embodiment of the present invention, the thickness of the resonator block is 0.3 mm, and the thickness of the metal layers coated on the block is 0.06 mm. Application of the above-mentioned dielectric resonator according to the present invention to an antenna will be explained next.

An object of using a dielectric resonator for an antenna is opposite to that of the VCO and filter. In the VCO and filter, the object is to minimize the loss in order to increase the quality factor, that is, the performance of the VCO and filter.

Whereas, the object in the antenna is to radiate energy as much as possible. The dielectric resonator according to the present invention has three end surfaces open to the air for radiation. An electrical field containment characteristic inside the resonator becomes weak if the dielectric constant of this dielectric resonator is lowered causing the radiation passing through the open end surfaces to increase. Thus, the dielectric resonator according to the present invention can be applied to an antenna by reducing a relative dielectric constant of dielectric material if necessary, although the size of the resonator will increase with the decrease of the dielectric constant or with the increase of the thickness for the same frequency application.

The configuration materials of the dielectric block and the metal layers in each of the aforementioned embodiments are merely examples, and it is apparent that the configuration materials are not limited to them. In addition, it is clear that the shape of the excitation electrode is not limited to an approximate rectangular shape, but any shape may be used.

First Embodiment of Dielectric Resonator Bandpass Filter

Figure 15:
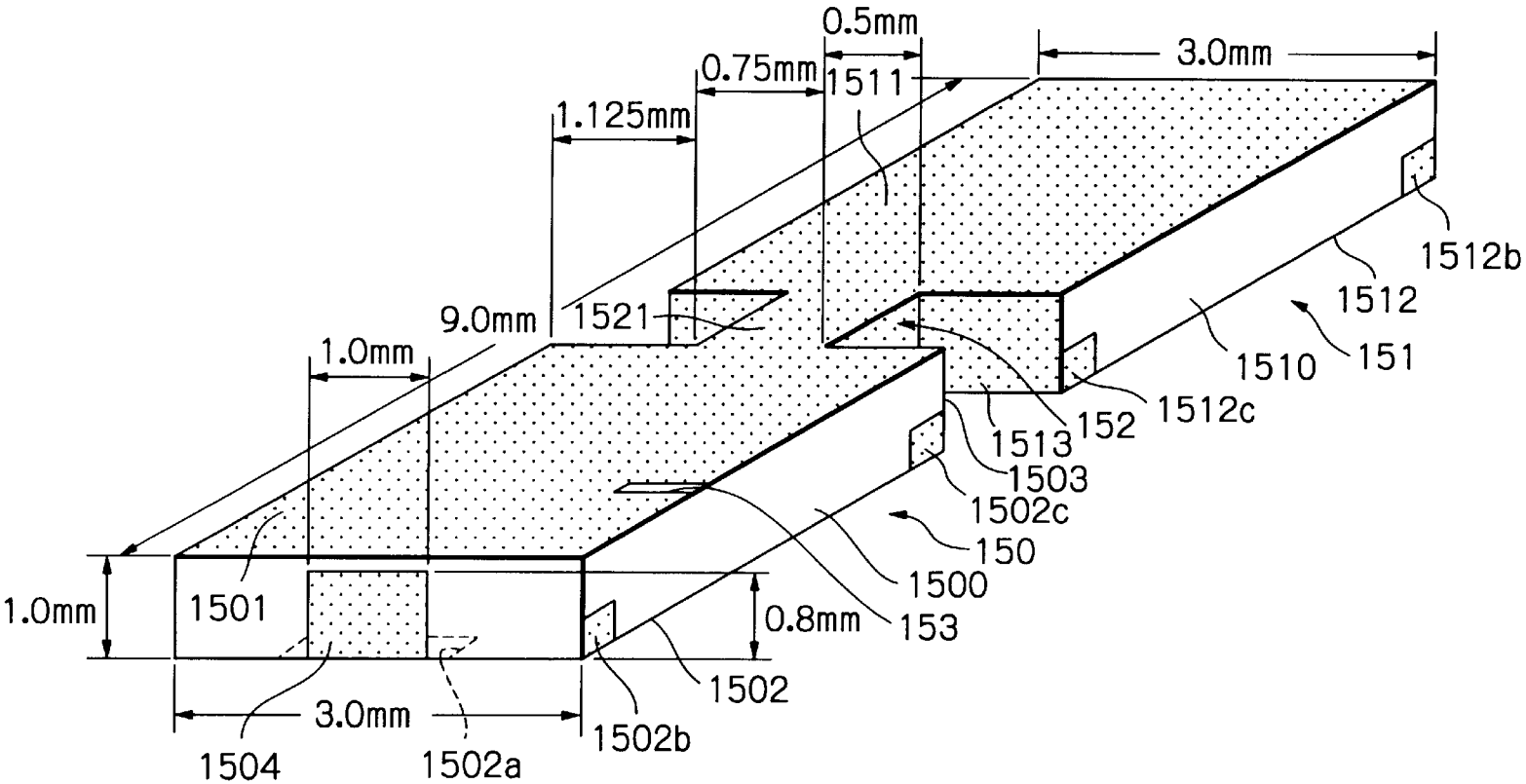
FIG. 15 is a perspective view schematically illustrating the configuration of a high frequency dielectric resonator bandpass filter with two dielectric resonators, as a first embodiment of the bandpass filter according to the present invention.

FIG. 15 schematically illustrates the configuration of a high frequency dielectric resonator bandpass filter with two dielectric resonators, as a first embodiment of the bandpass filter according to the present invention.

In the figure, reference numeral 150 denotes a first λ/4 dielectric resonator, and 151 a second λ/4 dielectric resonator, respectively. These two λ/4 resonators 150 and 151 are connected to each other via an evanescent mode waveguide (EW) 152.

Figure 16:
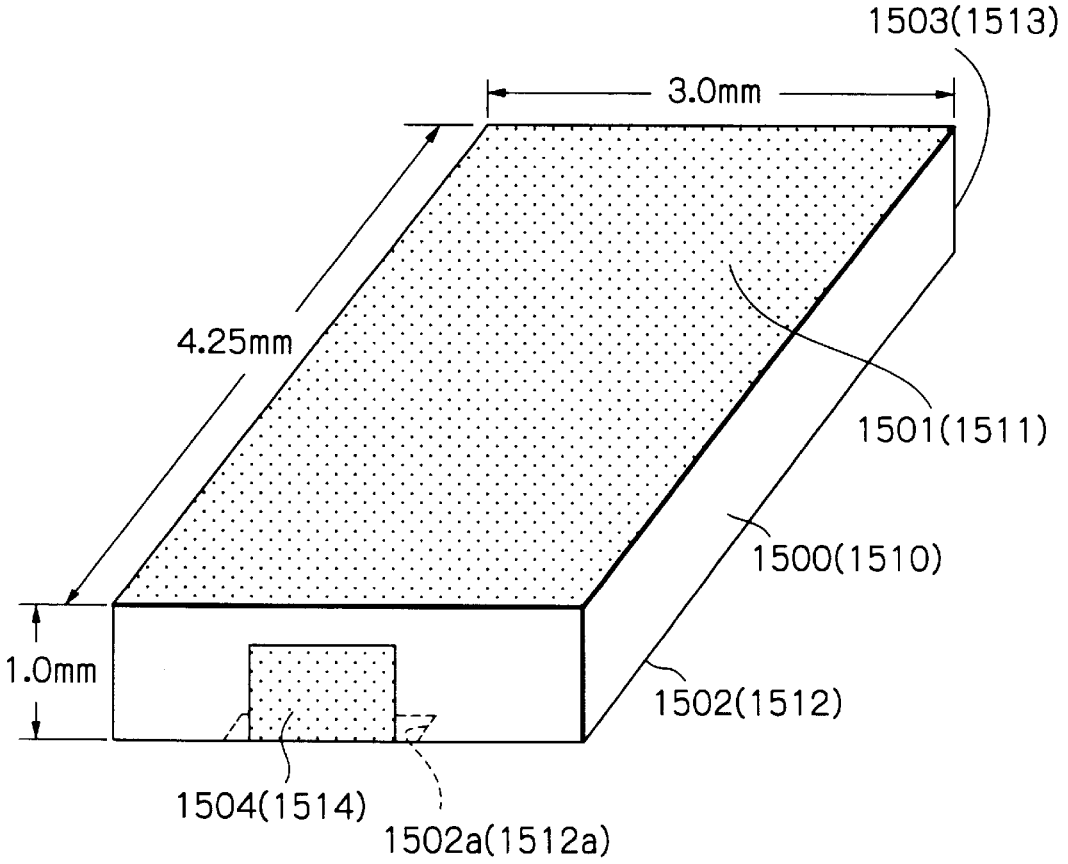
FIG. 16 is a perspective view schematically illustrating the configuration of each λ/4 dielectric resonator in the embodiment of FIG. 15.

FIG. 16 schematically illustrates the configuration of each of the λ/4 dielectric resonators 150 and 151. In the figure, reference numeral 1500 (1510) denotes a dielectric block with a rectangular planar shape, 1501 (1511) a metal layer coated on a top surface of the dielectric block 1500 (1510), and 1502 (1512) a metal layer coated on a bottom surface of the dielectric block 1500 (1510). The metal layer 1502 (1512) on the bottom surface is grounded. A metal layer 1503 (1513) on one of side walls corresponds to a perfect electric conductor (PEC) of a λ/2 resonator and short-circuits the top metal layer 1501 (1511) and the bottom metal layer 1502 (1512), and other three of the side walls is open to the air. An excitation electrode 1504 (1514) of an approximately rectangular metal pattern, for giving capacitive excitation to the resonator, is formed on the side wall of the dielectric block 1500 (1510) opposite to the side wall coated by the metal layer 1503 (1513). A cutout 1502 a (1512 a) to isolate the excitation electrode 1504 (1514) from the bottom grounded metal layer 1502 (1512) is provided in part of this metal layer 1502 (1512).

The EW 152 is connected between the shorted end surfaces of these two λ/4 resonators 150 and 151. A metal layer 1521 is coated on all the surfaces of this EW 152 except for these connected end areas.

As aforementioned, the metal layers 1502 and 1512 formed on the bottom surfaces of the dielectric blocks 1500 and 1510 are grounded. These metal layers 1502 and 1512 have extensions 1502*b,* 1502*c,* 1512*b* and 1512*c* extending to opposite side walls of the dielectric blocks 1500 and 1510, for easily connecting these layers to the ground by soldering.

In this embodiment, the excitation electrodes 1504 and 1514 are formed on the opposite side walls of the filter, respectively. The dielectric blocks 1500 and 1510, and the block of the EW 152 are formed with dielectric material having a comparatively high relative dielectric constant of 93, and the metal layers 1501, 1511, 1502, 1512 and 1521, and the excitation electrodes 1504 and 1514 are made of silver.

It is the most important part of the present invention to use the TEM mode λ/4 dielectric resonator. This is because a substantial decrease in volume of the filter is possible owing to this usage.

Besides, by using dielectric material with a high dielectric constant, the thickness of the λ/4 dielectric resonator in this embodiment was optimized at 1.00 mm as described in the literature [1]. Thus, it has been succeeded to fabricate a new filter with a thickness of 1 mm that can easily cope with the latest technological innovation.

Coupling strength of the two λ/4 dielectric resonators 150 and 151 can be controlled by changing the dimensions of the EW 152 substantially composed of dielectric material that is the same material as these dielectric resonators.

Figure 1:
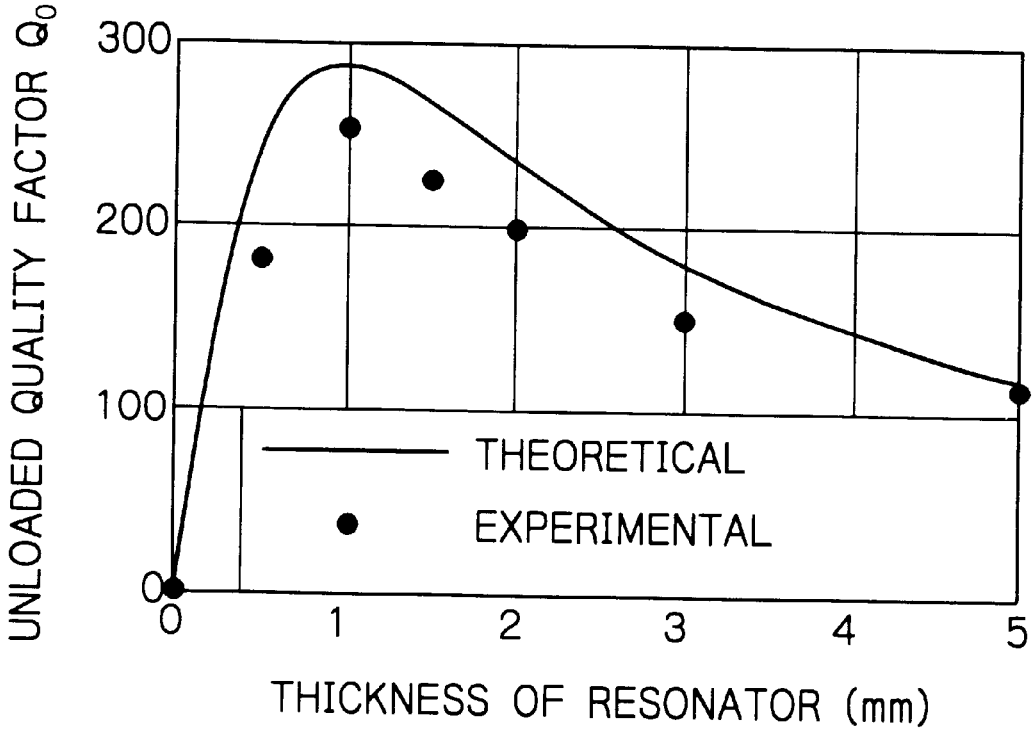
FIG. 1 already described is a graph illustrating the result of a theoretically and experimentally verifying relationship between the thickness and the unloaded quality factor $Q_0$ regarding the resonator in the known literature.
Figure 18:
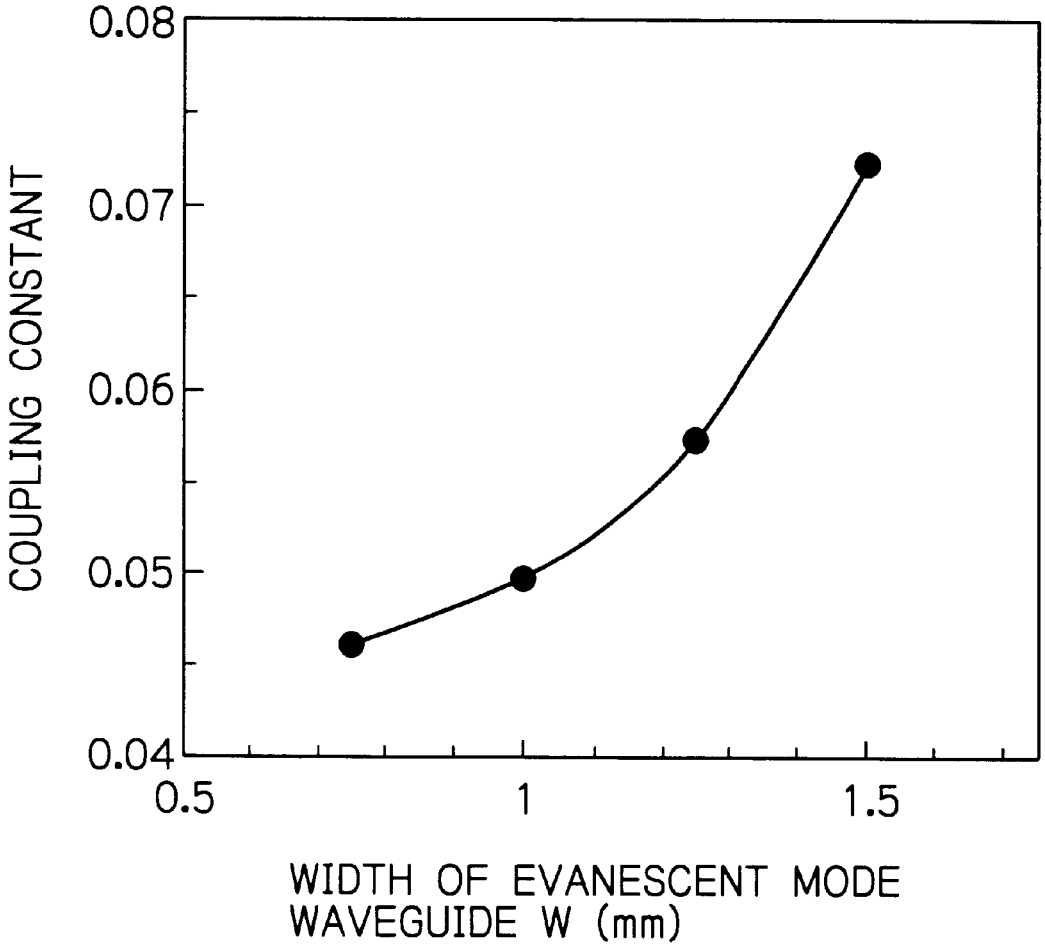
FIG. 18 is a graph illustrating changes of a coupling constant versus a width w of the evanescent mode waveguide.

FIG. 1 7 illustrates the characteristic of the coupling constant versus the length 1 of the EW 152, and FIG. 18 illustrates the characteristic of the coupling constant versus the width w of the EW 152.

Figure 17:
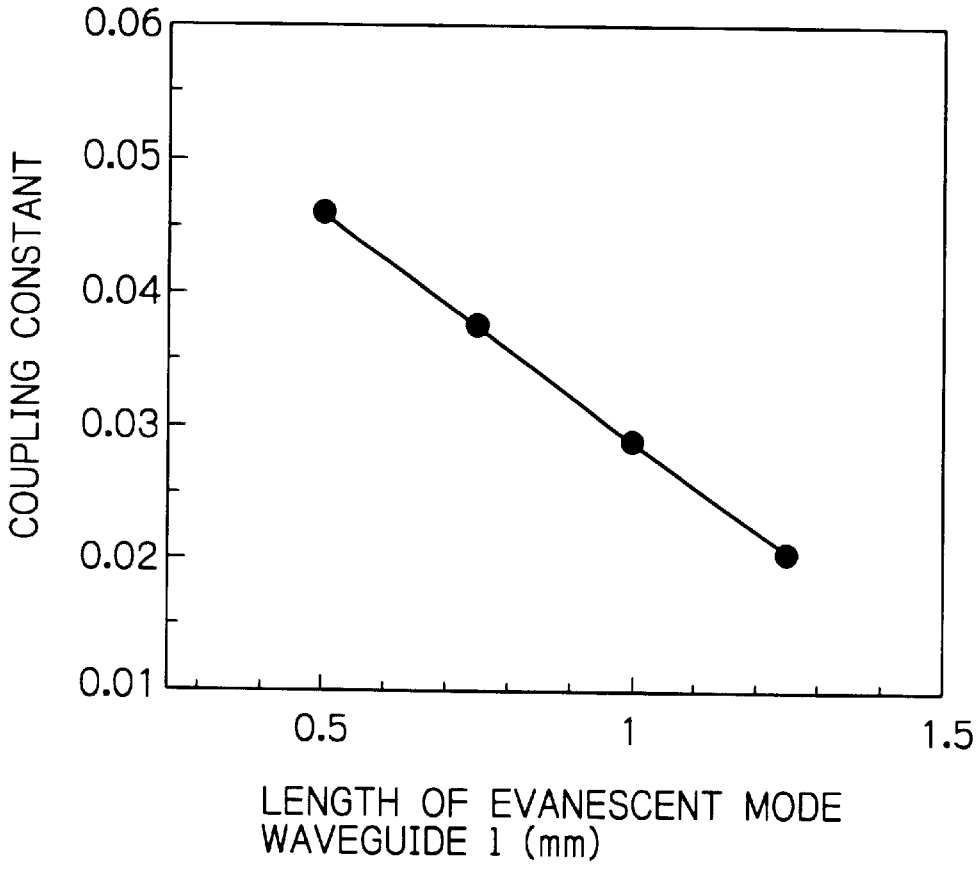
FIG. 17 is a graph illustrating changes of a coupling constant versus a length 1 of an evanescent mode waveguide.

As will be apparent from FIG. 17, if width w of the EW 152 is fixed, the coupling constant linearly decreases as its length 1 increases. On the other hand, if the length 1 of the EW 152 is fixed, the coupling constant increases in a curve as its width w increases as shown in FIG. 18. Thus, it is possible to obtain a desired coupling constant by setting the length 1 and/or the width w of the EW 152 adequately.

Figure 19:
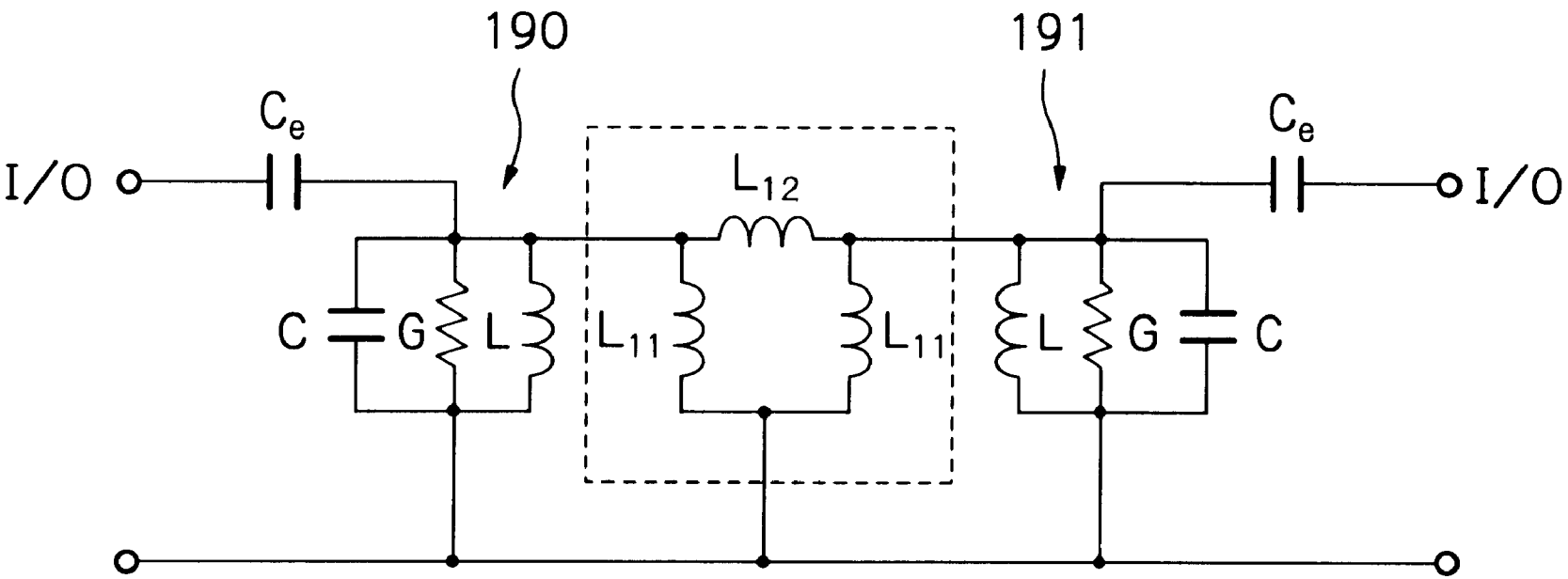
FIG. 19 is a circuit diagram illustrating an equivalent circuit of the bandpass filter in the embodiment of FIG. 15.

FIG. 19 illustrates an equivalent circuit of the bandpass filter in this embodiment.

The H-evanescent waveguide 152 placed between the two λ/4 resonators 150 and 151 forms a π type inductive coupling circuit. In FIG. 19, the two λ/4 resonators 150 and 151 are represented by two L-C parallel circuits 190 and 191, respectively. G is derived from the loss factor. Electrical input/output ports are represented by two capacitors $C_e$. The EW 152 provides a series coupling inductance $L_{12}$ between the two resonators 150 and 151 and a pair of shunt coupling inductances $L_{11}$ grounded in the electrical schematic diagram.

The two λ/4 resonators 150 and 151 should have the same dimensions so as to generate the same resonant frequency. If the two resonant frequencies are minutely different, it is possible to compensate this difference by providing an extremely narrow slit 153 in the metal layer 1501 on the top planar surface of the resonator as shown in FIG. 15. This slit 153 should be formed along a direction perpendicular to the mode propagation.

The frequency-tuning slit may be provided in both the resonators 150 and 151, or in any one of them as this embodiment. Also the frequency-tuning slit may be located at any position including a central section and a periphery of the top metal layer. Furthermore, the extension direction of the slit may be designed to any direction except for the mode propagation. In addition, a plurality of slits may be provided.

The above described concept has been experimentally verified by constructing a two-pole TEM mode bandpass filter and measuring its performance.

Figure 20:
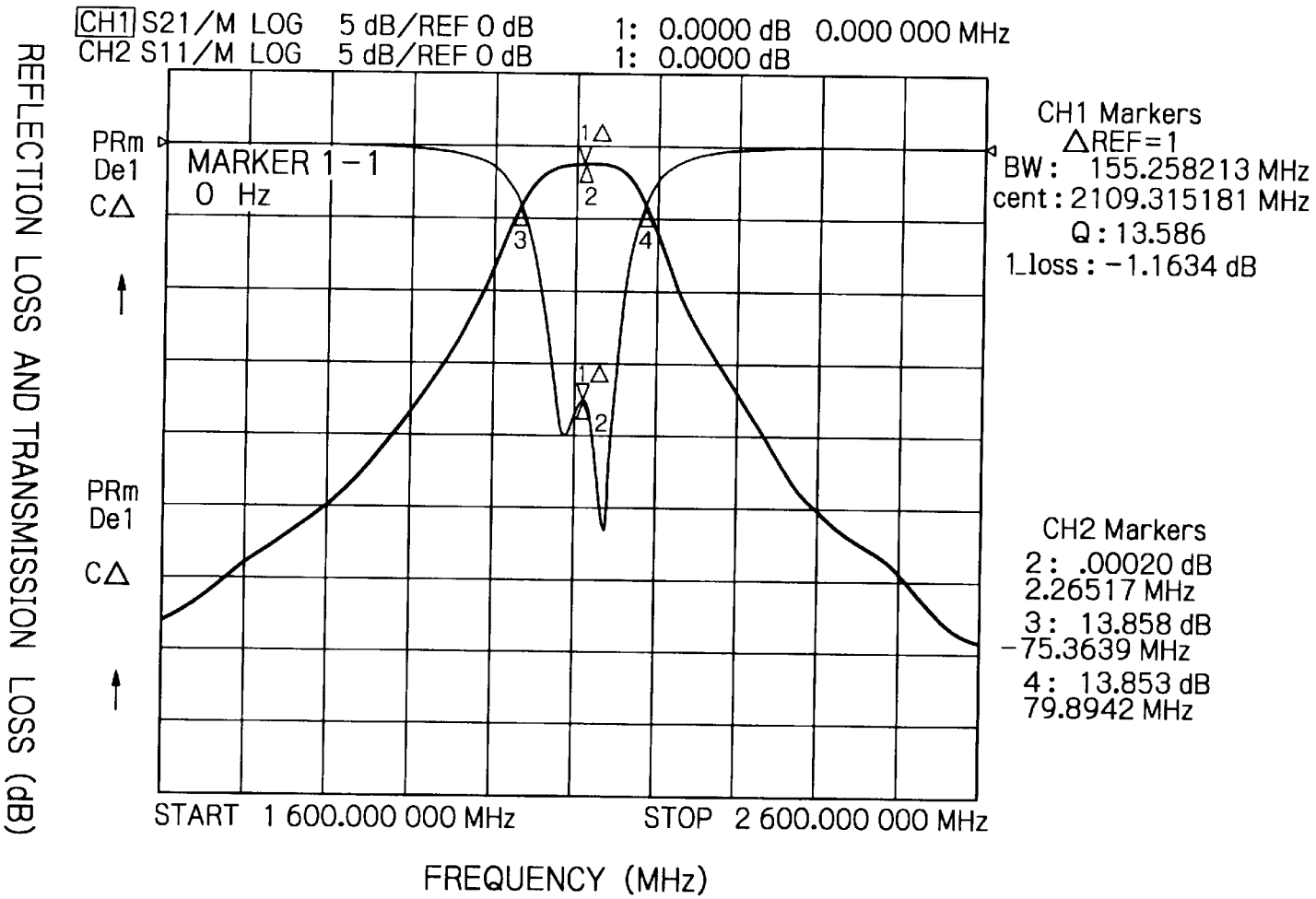
FIG. 20 is a graph obtained by actually measuring a frequency characteristic of reflection loss and transmission loss in the bandpass filter in the embodiment of FIG. 15.

FIG. 20 illustrates an actually measured frequency characteristic of reflection loss and transmission loss in this bandpass filter. As will be understood from the figure, this filter is a high-performance and low insertion loss bandpass filter usable in wide-band CDMA application.

Figure 21:
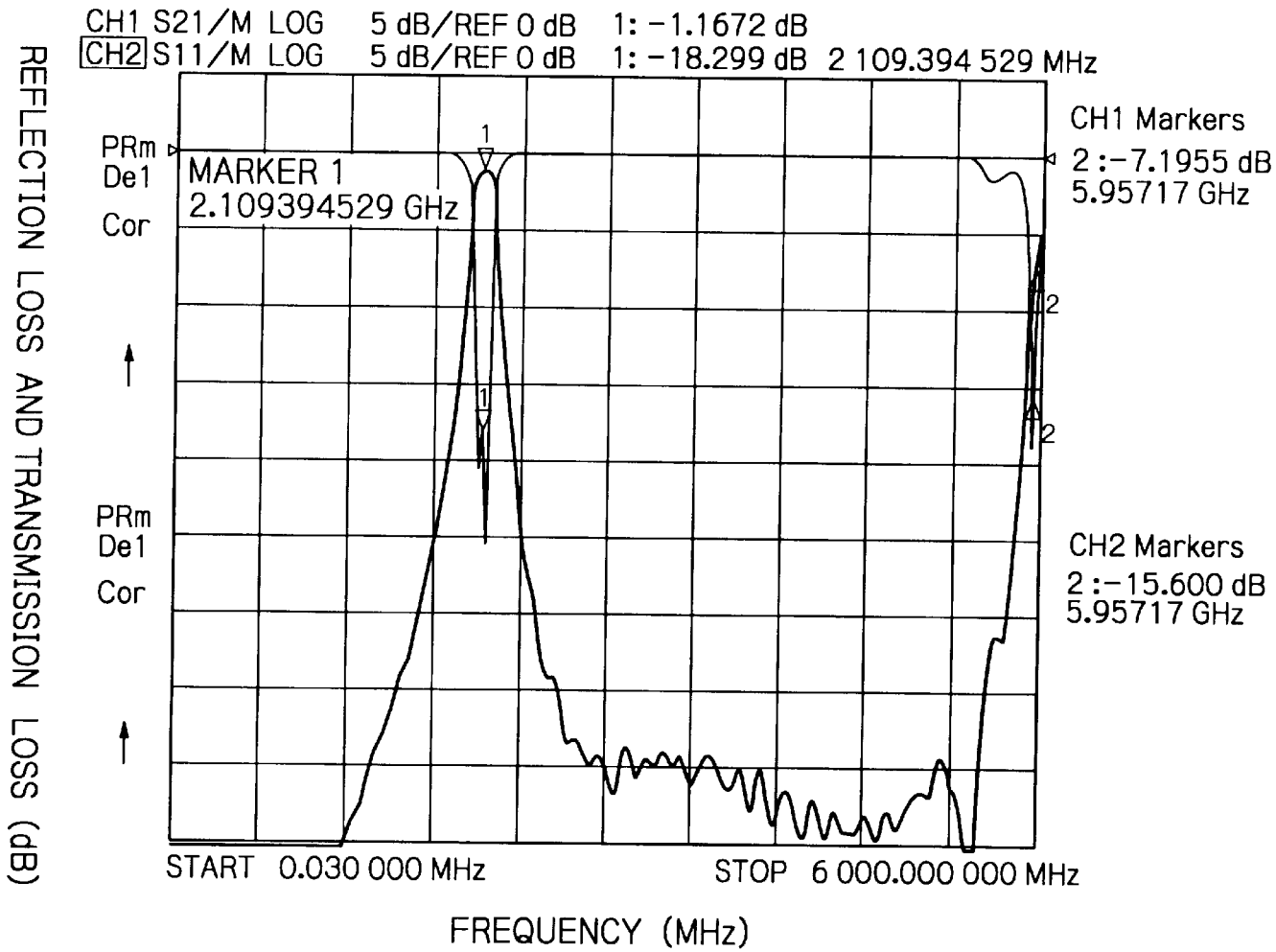
FIG. 21 is a graph obtained by actually measuring a wide band frequency characteristic of reflection loss and transmission loss so as to know the spurious performance of the bandpass filter in the embodiment of FIG. 15.

FIG. 21 illustrates an actually measured wider-band frequency characteristic of reflection loss and transmission loss so as to know the spurious performance of this bandpass filter. As will be apparent from the figure, the characteristic of this filter using the TEM mode is entirely free from the effect of spurious responses. In this experiment, the EW 152 was designed to have a thickness of w=0.75 mm and a length of 1=0.5 mm.

The remarkably thin dielectric filter in this embodiment can provide drastic shrinkage of dimensions with maintaining its performance in comparison with the conventional dielectric waveguide filter. This TEM mode dielectric resonator filter can be applied to a mobile terminal in a wideband CDMA system and other various kinds of applications where signal processing is required.

Second Embodiment of Dielectric Resonator Bandpass Filter

Figure 22:
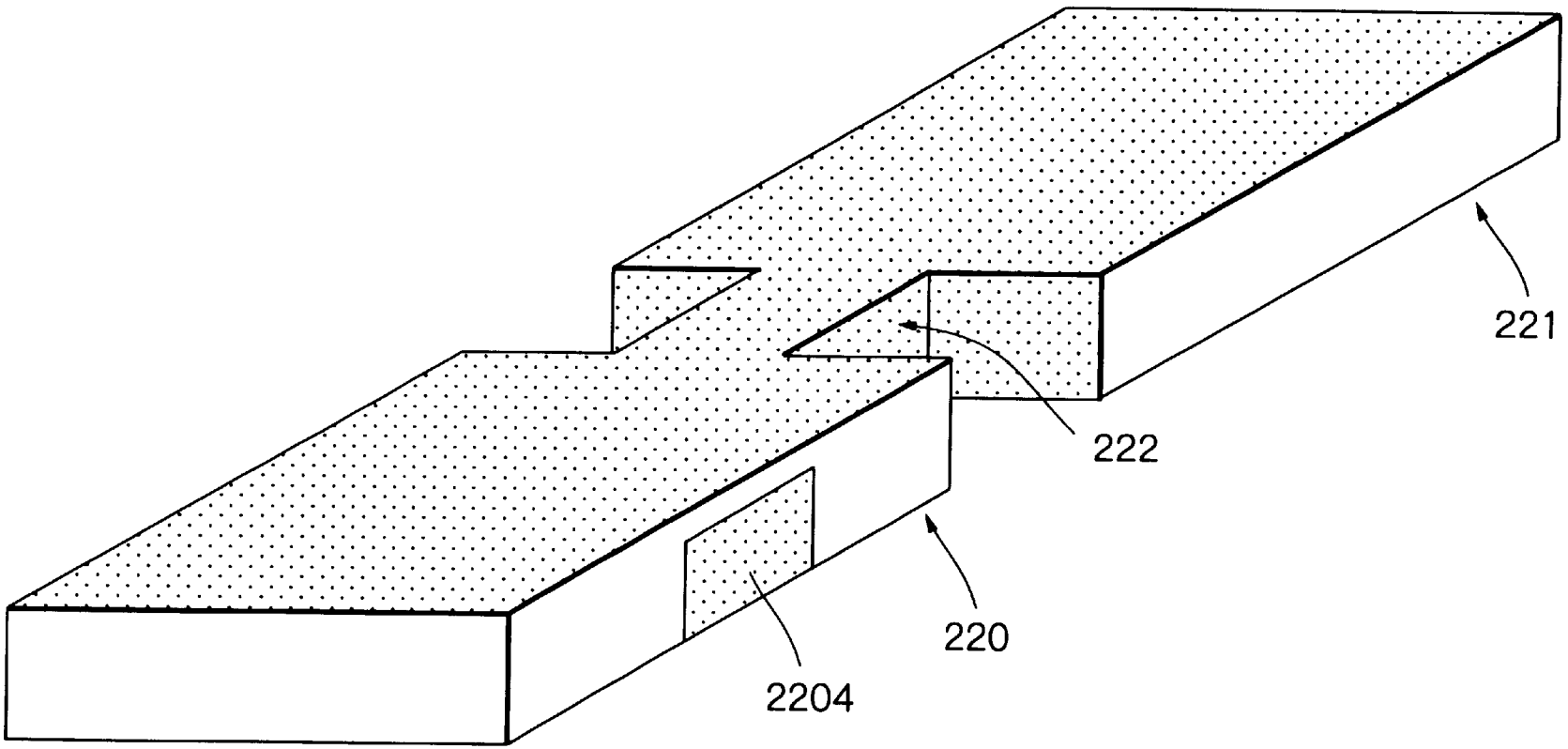
FIG. 22 is a perspective view schematically illustrating the configuration of a high frequency dielectric resonator bandpass filter with two dielectric resonators, as a second embodiment of the bandpass filter according to the present invention.

FIG. 22 schematically illustrates the configuration of a high frequency dielectric resonator bandpass filter with two dielectric resonators, as a second embodiment of the bandpass filter according to the present invention.

In the figure, reference numeral 220 denotes a first λ/4 dielectric resonator, and 221 a second λ/4 dielectric resonator, respectively. These two λ/4 resonators 220 and 221 are connected to each other via an evanescent mode waveguide (EW) 222.

This embodiment has the same configuration as the embodiment shown in FIG. 15 except that, in this embodiment, an excitation electrode 2204 of the λ/4 resonator 220 and an excitation electrode (not shown) of the λ/4 resonator 221 are formed on side walls orthogonal to the shorted end surfaces, respectively. In particular, in this embodiment, each excitation electrode of the λ/4 resonators 220 and 221 is formed on each left side wall with viewing each resonator from the shorted ends.

Other configuration, operations and advantages in this embodiment are the same as those in the embodiment in FIG. 15.

Third Embodiment of Dielectric Resonator Bandpass Filter

Figure 23:
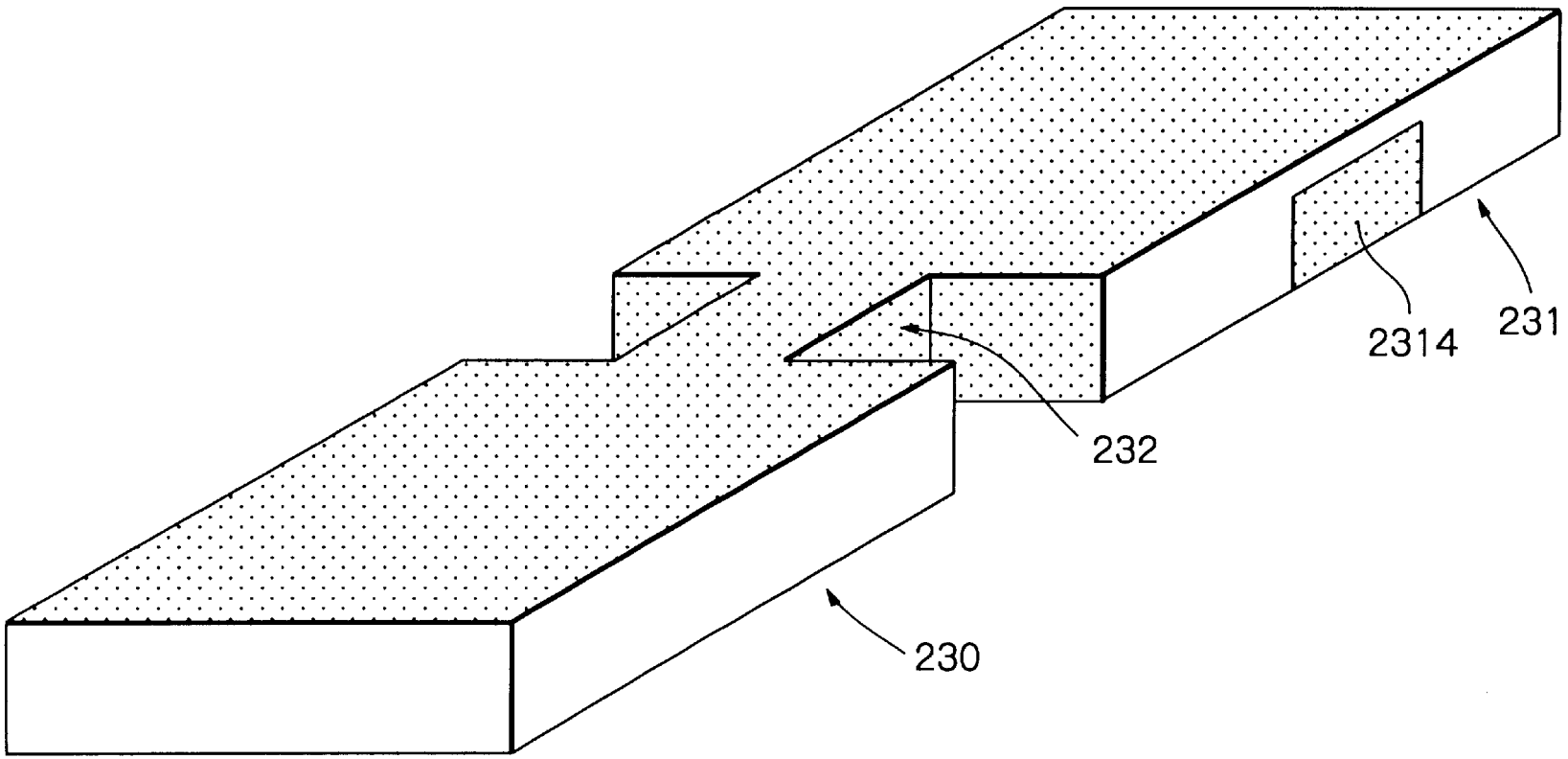
FIG. 23 is a perspective view schematically illustrating the configuration of a high frequency dielectric resonator bandpass filter with two dielectric resonators, as a third embodiment of the bandpass filter according to the present invention.

FIG. 23 schematically illustrates the configuration of a high frequency dielectric resonator bandpass filter with two dielectric resonators, as a third embodiment of the bandpass filter according to the present invention.

In the figure, reference numeral 230 denotes a first λ/4 dielectric resonator, and 231 a second λ/4 dielectric resonator, respectively. These two λ/4 resonators 230 and 231 are connected to each other via an evanescent mode waveguide (EW) 232.

This embodiment has the same configuration as the embodiment shown in FIG. 15 except that, in this embodiment, an excitation electrode (not shown) of the λ/4 resonator 230 and an excitation electrode 2314 of the λ/4 resonator 231 are formed on side walls orthogonal to the shorted end surfaces, respectively. In particular, in this embodiment, each excitation electrode of the λ/4 resonators 230 and 231 is formed on each right side wall with viewing each resonator from the shorted ends.

Other configuration, operations and advantages in this embodiment are the same as those in the embodiment in FIG. 15.

Fourth Embodiment of Dielectric Resonator Bandpass Filter

Figure 24:
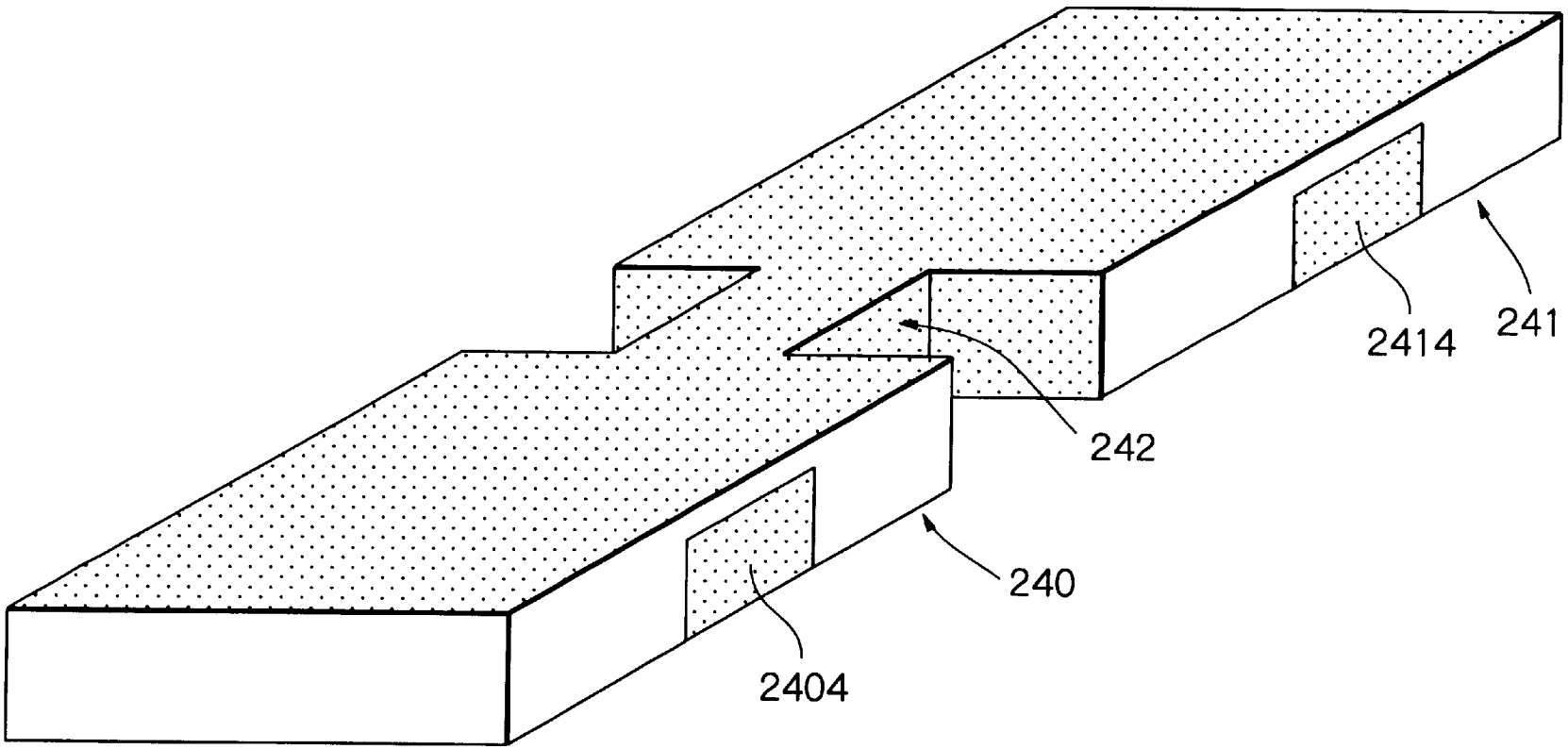
FIG. 24 is a perspective view schematically illustrating the configuration of a high frequency dielectric resonator bandpass filter with two dielectric resonators, as a fourth embodiment of the bandpass filter according to the present invention.

FIG. 24 schematically illustrates the configuration of a high frequency dielectric resonator bandpass filter with two dielectric resonators, as a fourth embodiment of the bandpass filter according to the present invention.

In the figure, reference numeral 240 denotes a first λ/4 dielectric resonator, and 241 a second λ/4 dielectric resonator, respectively. These two λ/4 resonators 240 and 241 are connected to each other via an evanescent mode waveguide (EW) 242.

This embodiment has the same configuration as the embodiment shown in FIG. 15 except that, in this embodiment, an excitation electrode 2404 of the λ/4 resonator 240 and an excitation electrode 2414 of the λ/4 resonator 241 are formed on side walls orthogonal to the shorted end surfaces, respectively. In particular, in this embodiment, the excitation electrode 2404 of the λ/4 resonator 240 is formed on the left side wall with viewing the resonator from the shorted end, and the excitation electrode 2414 of the λ/4 resonator 241 is formed on the right side wall with viewing the resonator from the shorted end.

Other configuration, operations and advantages in this embodiment are the same as those in the embodiment in FIG. 15.

The configuration materials of the dielectric block, the EW and the metal layers in each of the aforementioned embodiments are merely examples, and it is apparent that the configuration materials are not limited to them. In addition, it is clear that the shape of the excitation electrode is not limited to an approximate rectangular shape, but any shape may be used.

Fifth Embodiment of Dielectric Resonator Bandpass Filter

Figure 25:
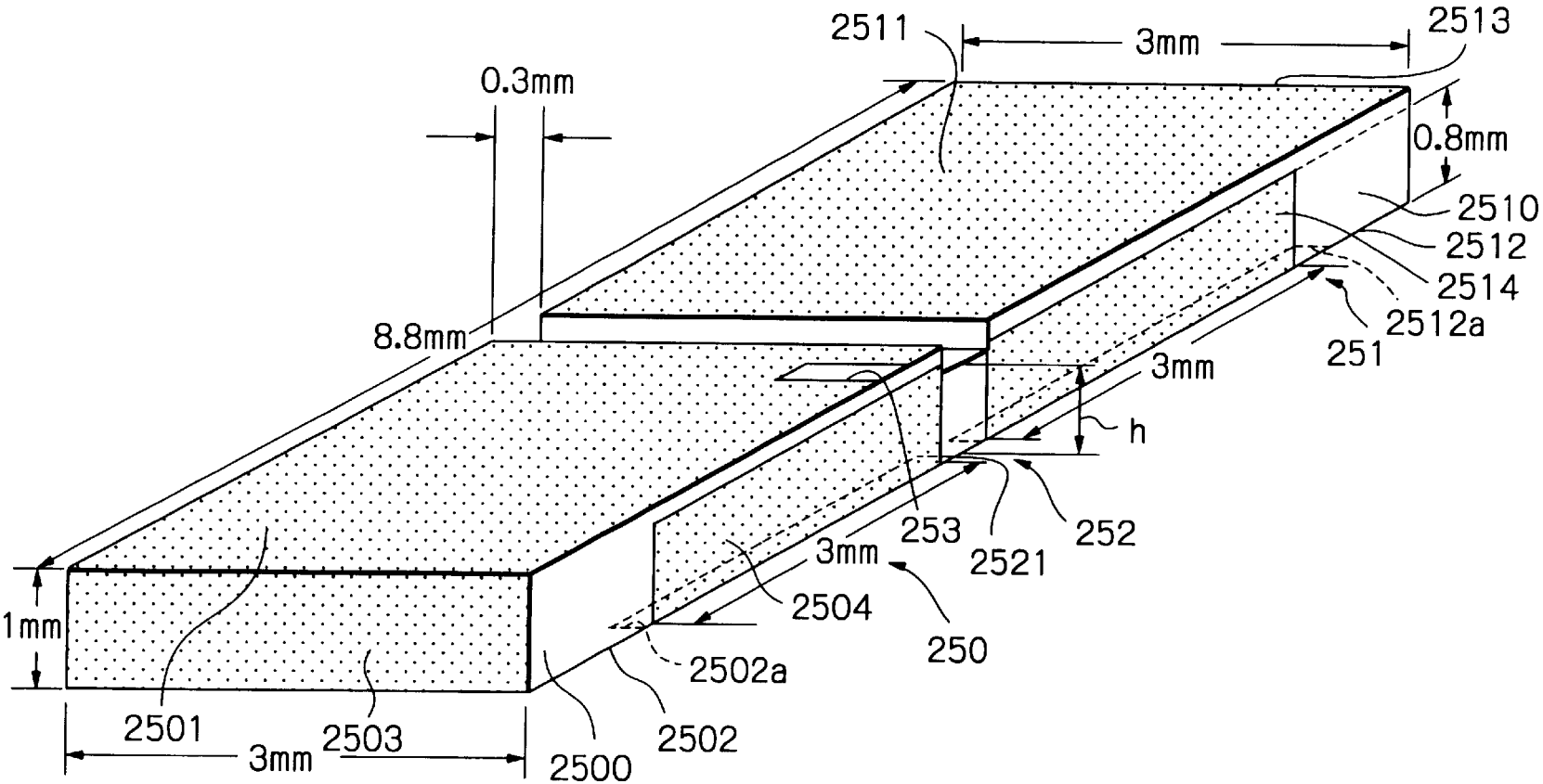
FIG. 25 is a perspective view schematically illustrating the configuration of a high frequency dielectric resonator bandpass filter with two dielectric resonators, as a fifth embodiment of the bandpass filter according to the present invention.
Figure 26:
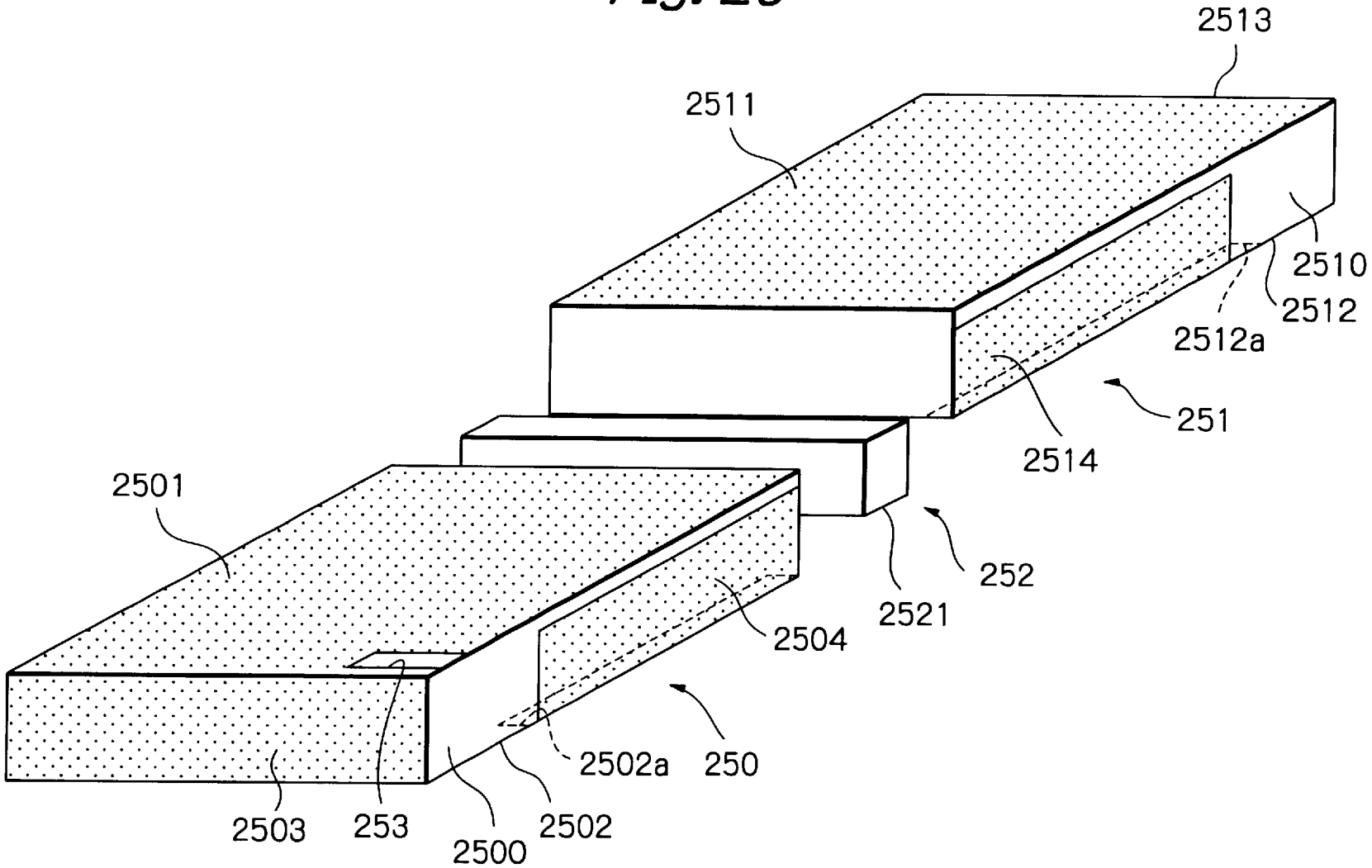
FIG. 26 is an exploded perspective view of the bandpass filter in the embodiment of FIG. 25.
Figure 27:
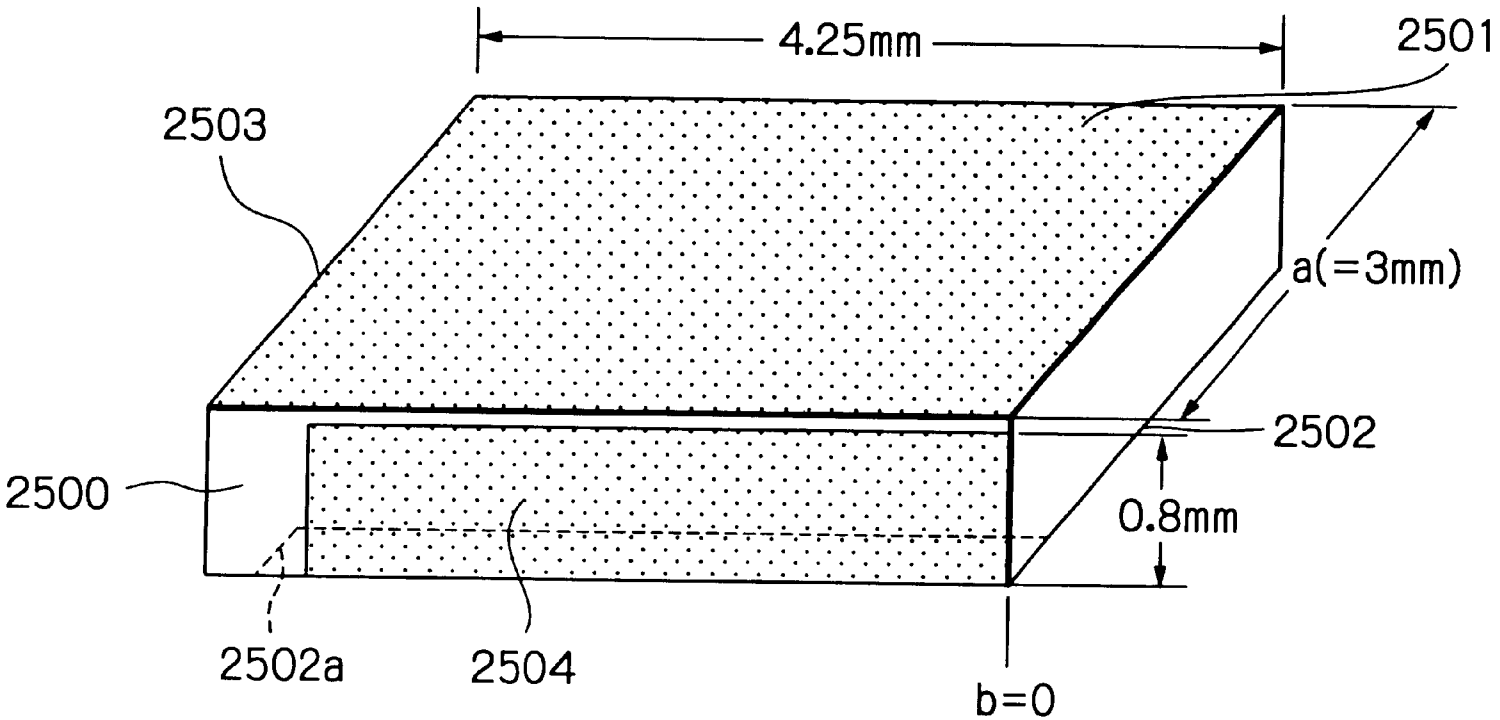
FIG. 27 is a perspective view schematically illustrating the configuration of a λ/4 dielectric resonator in the embodiment of FIG. 25.

FIG. 25 schematically illustrates the configuration of a high frequency dielectric resonator bandpass filter with two dielectric resonators, as a fifth embodiment of the bandpass filter according to the present invention, FIG. 26 illustrates its exploded perspective view, and FIG. 27 schematically illustrates the configuration of each resonator of the filter.

In these figures, reference numeral 250 denotes a first λ/4 dielectric resonator, and 251 a second λ/4 dielectric resonator, respectively. These two λ/4 resonators 250 and 251 are connected to each other via an evanescent E-mode waveguide 252.

As clearly shown in FIG. 27, each of the λ/4 dielectric resonators 250 and 251 includes a dielectric block 2500 (2510) with a rectangular planar shape, a metal layer 2501 (2511) coated on a top surface of the dielectric block 2500 (2510), and a metal layer 2502 (2512) coated on a bottom surface of the dielectric block 2500 (2510). The metal layer 2502 (2512) on this bottom surface is grounded.

Although not shown in FIG. 27, a metal layer 2503 (2513) on one of side walls corresponds to a perfect electric conductor (PEC) where electrical fields in a λ/2 resonator becomes at the minimum, and short-circuits the top metal layer 2501 (2511) and the bottom metal layer 2502 (2512). Other three of the side walls are open to the air. An excitation electrode 2504 (2514) of an approximately rectangular metal pattern, for giving capacitive excitation to the resonator, is formed on the side wall of the dielectric block 2500 (2510) orthogonal to the metal layer 2503 (2513). A cutout **2502*a* (2512*a*) to isolate the excitation electrode 2504 (2514) from the bottom grounded metal layer 2502 (2512) is provided in part of this metal layer 2502 (2512)**.

In this embodiment, the evanescent E-mode waveguide 252 consists of a dielectric block having a rectangular planar shape, and only its bottom planar surface is coated with the metal layer 2521 and grounded. All of the top planar surface and the four side walls of the dielectric block 252 are open to the air.

The two open side walls of the evanescent E-mode waveguide 252 are connected between the open side walls opposite to the respective shorted end surfaces of the two λ/4 resonators 250 and 251. In each of the λ/4 resonators 250 and 251, electrical fields become the maximum at the open end surface opposite to the shorted end. Accordingly, at this open end surface, the capacitive coupling is the most effective.

As aforementioned, the metal layers 2502 and 2512 formed on the respective bottom surfaces of the dielectric blocks 2500 and 2510 are grounded.

In this embodiment, excitation electrodes 2504 and 2514 are formed on the respective side walls that are orthogonal to the shorted end surfaces of the dielectric blocks 2500 and 2510 and face to the same direction. In other words, the excitation electrode 2504 of the λ/4 resonator 250 is formed on the right side wall with viewing the resonator from the shorted end, and the excitation electrode 2514 of the λ/4 resonator 251 is formed on the left side wall with viewing the resonator from the shorted end.

The dielectric blocks 2500 and 2510, and the dielectric waveguide 252 are formed with dielectric material having a comparatively high relative dielectric constant of 93, and the metal layers 2501, 2511, 2502, 2512, 2503, 2513 and 2521, and the excitation electrodes 2504 and 2514 are made of silver.

It is the most important part of the present invention to use TEM mode λ/4 dielectric resonators. This is because a substantial decrease in volume of the filter is possible owing to this usage.

Besides, by using dielectric material with a high dielectric constant, the thickness of the λ/4 dielectric resonator in this embodiment was optimized at 1.00 mm as described in the literature [1]. Thus, it has been succeeded to fabricate a new filter with a thickness of 1 mm that can easily cope with the latest technological innovation.

An external quality factor $Q_e$ indicates the external circuit coupling of the resonator. This external quality factor is equal to the inverse of the internal resonator coupling strength. This external quality factor $Q_e$ can be controlled by changing the dimensions such as the height and the width of the excitation electrodes 2504 and 2514.

Figure 28:
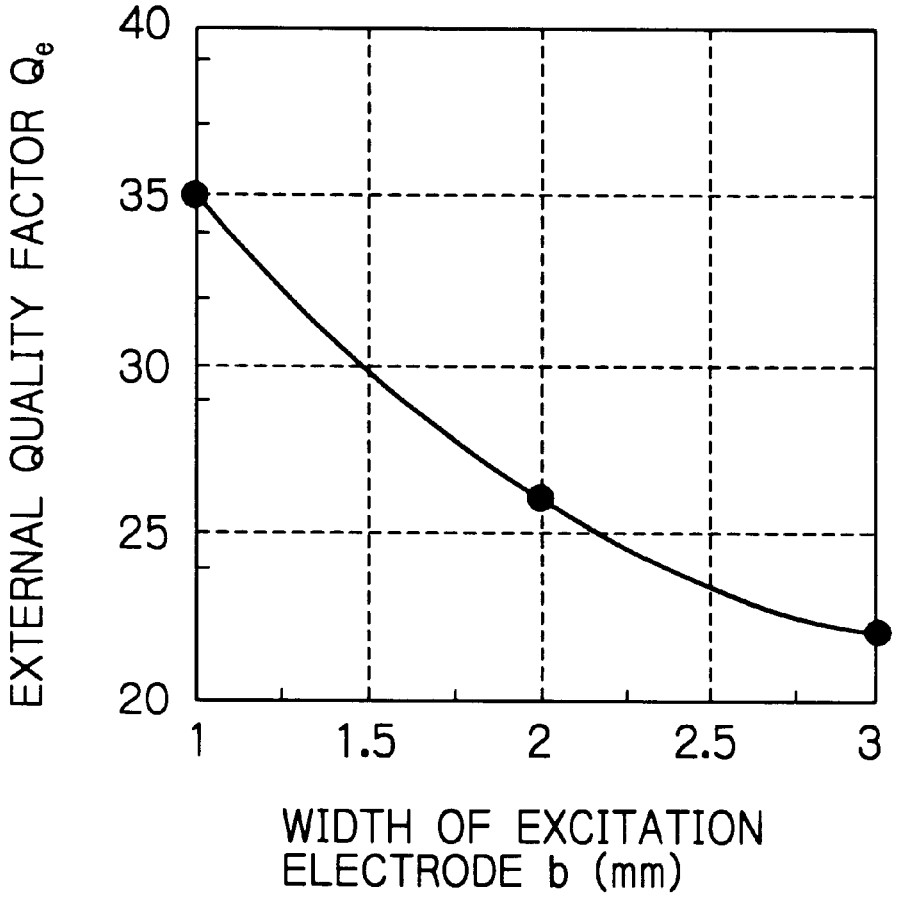
FIG. 28 is a graph illustrating changes of an external quality factor $Q_e$ versus a width b of an excitation electrode.

FIG. 28 illustrates the measured result of the external quality factor $Q_e$ for various width b of the excitation electrode when keeping the excitation electrode height at 0.8 mm. From this figure, it can be observed that the external quality factor $Q_e$ decreases from 35 to 22 when the width of the excitation electrodes 2504 and 2514 increases from 1 mm to 3 mm.

The capacitive coupling strength between the two λ/4 dielectric resonators 250 and 251 can be controlled by changing the dimensions such as for example the thickness h of the evanescent E-mode waveguide 252 made of dielectric material that is the same as that of these dielectric resonators.

Figure 29:
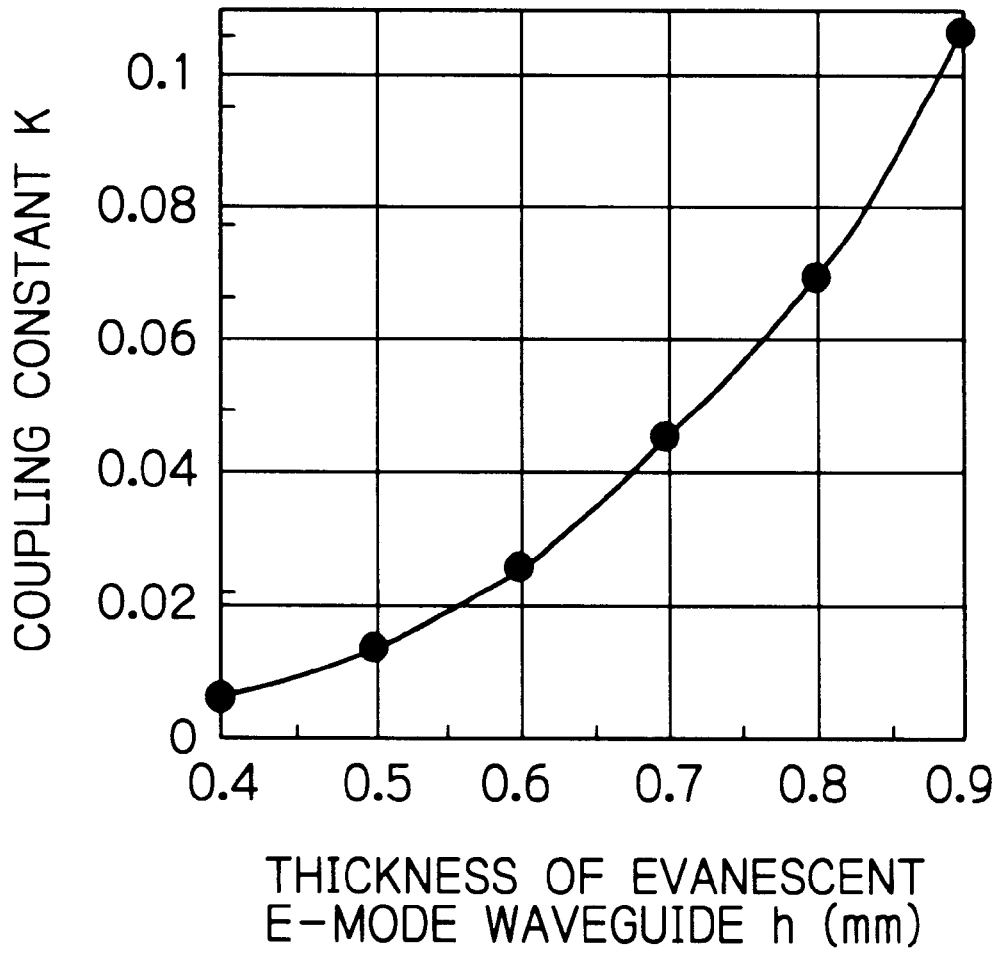
FIG. 29 is a graph illustrating changes of a coupling constant k versus a thickness h of an evanescent mode waveguide.

FIG. 29 illustrates the characteristic of changes of the coupling constant k versus changes of the thickness h when keeping the width of the evanescent E-mode waveguide 252 at 0.3 mm. As will be apparent from the figure, the coupling constant increases in a curve as the thickness h of the evanescent E-mode waveguide increases. For example, the coupling constant k increases from 0.007 to 0.106 when the thickness h increases from 0.4 mm to 0.9 mm.

The external quality factor $Q_e$ should be equal to the inverse of the strength of coupling between two resonators in order to obtain an adequately coupled two-pole bandpass filter. From FIG. 28, the external quality factor $Q_e$ becomes nearly 22 when the width b of the excitation electrode is 3 mm. Thus, the required internal coupling constant is nearly 0.045. From FIG. 29, it can be supposed that this constant will be obtained if the evanescent E-mode waveguide 252 is fabricated to have the thickness h of 0.7 mm.

As a result, a bandpass filter having the configuration shown in FIG. 25 has been obtained. Where the height and the width of the excitation electrodes 2504 and 2514 are 0.8 mm and 3 mm, respectively, and the length×the width×the thickness of the evanescent E-mode waveguide 252 are 0.3 mm×3 mm×0.7 mm.

Figure 30:
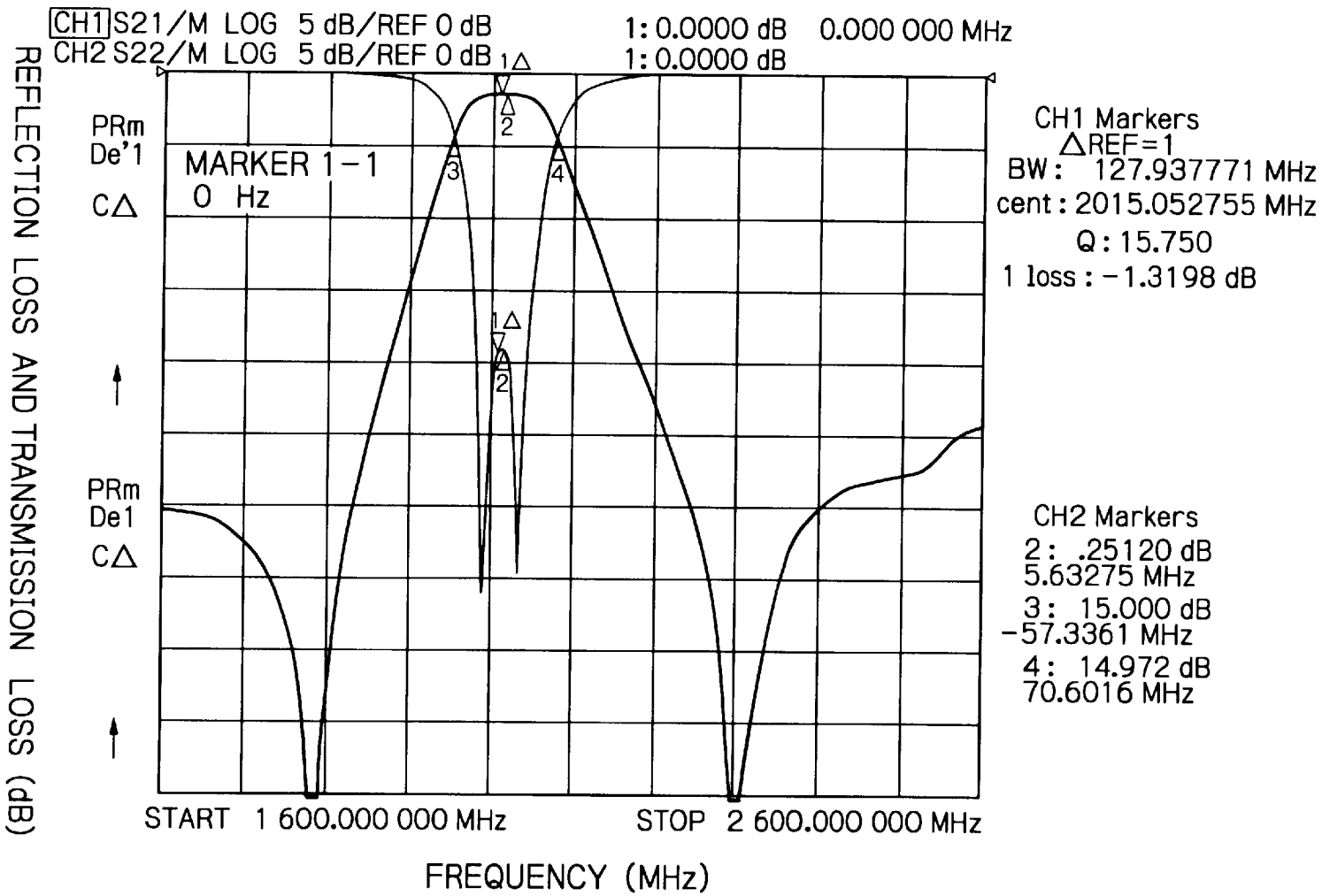
FIG. 30 is a graph obtained by actually measuring a frequency characteristic of reflection loss and transmission loss in the bandpass filter in the embodiment of FIG. 25.

FIG. 30 illustrates an actually measured frequency characteristic of reflection loss and transmission loss in this bandpass filter.

As will be understood from the figure, this filter is a high-performance and low insertion loss bandpass filter usable in wide-band CDMA application. In addition, this bandpass filter has an unintentional attenuation pole at each side of the passband. Due to the existence of these attenuation poles, it is possible to obtain a characteristic sharply falling at both ends of the passband. The insertion loss of this filter is 1.3 dB, the reflection loss is 19 dB, the 3 dB bandwidth is 128 MHz, and the filter frequency is 2.015 GHz.

The designed filter is a maximally-flat type. The coupling constant k of this filter is obtained by the following equation:

$$k = \frac{1}{\sqrt{g_1 g_2}} \frac{B}{f_0}$$

where B is the 3 dB bandwidth, $f_0$ is the filter frequency and $g_1$ and $g_2$ are a constant of 1.414 in case of the maximally-flat type filter. The coupling constant k obtained from the above equation is k=0.0449 which almost coincides with a designed value.

The evanescent E-mode waveguide 252 that mainly has capacitive energy provides a series capacitive coupling and a pair of shunt coupling capacitance connected to the grounded.

Figure 31:
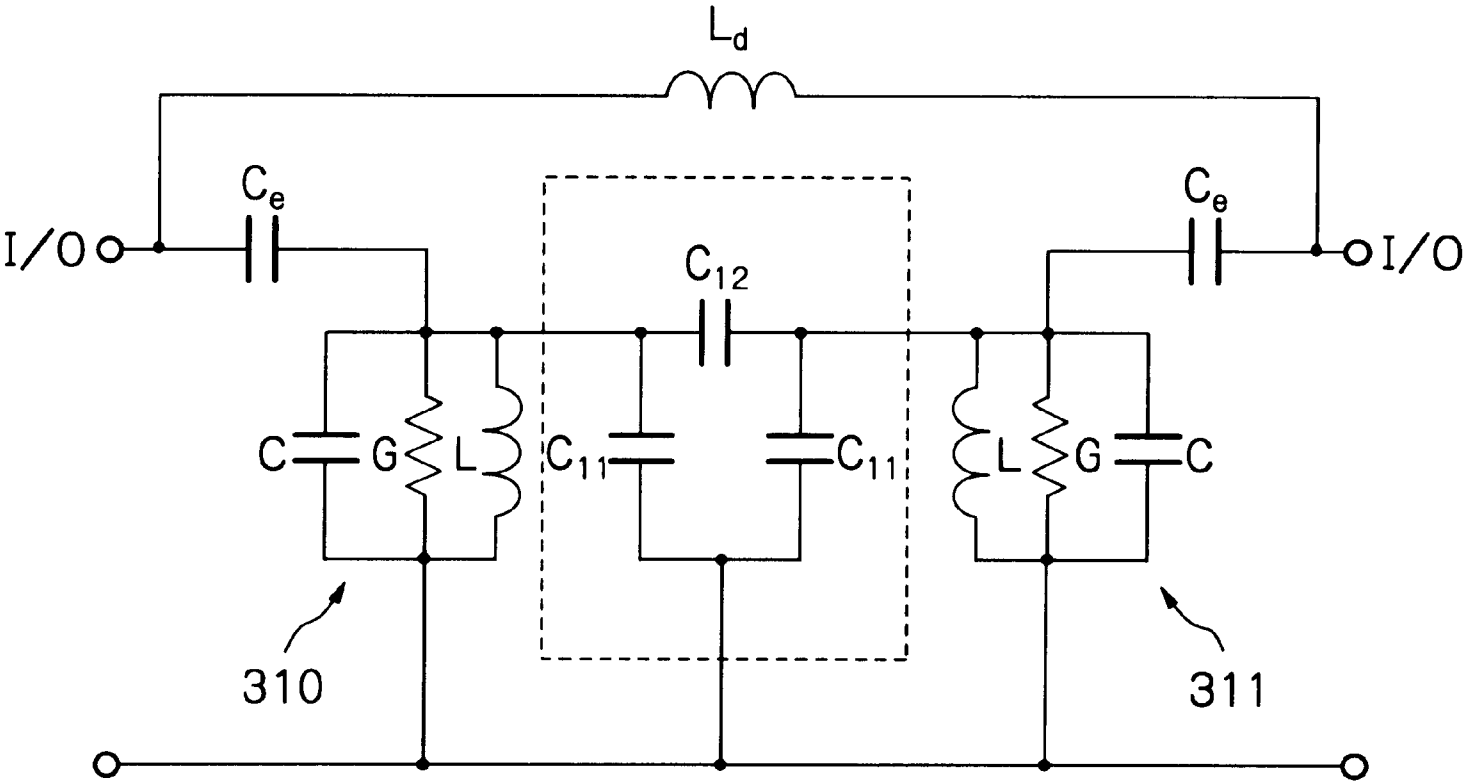
FIG. 31 is a circuit diagram illustrating an equivalent circuit of the bandpass filter in the embodiment of FIG. 25.

FIG. 31 illustrates an equivalent circuit of the bandpass filter in this embodiment.

In the figure, the two λ/4 dielectric resonators 250 and 251 are represented by two L-C parallel circuits 310 and 311, respectively. G is derived from the loss factor. Electrical input/output ports are represented by two capacitors $C_e$. $L_d$ represents a direct coupling inductance between the electrical input/output ports. The evanescent E-mode waveguide 252 provides a series coupling capacitance (internal coupling capacitance) $C_{12}$ between the two resonators 250 and 251 and a pair of shunt coupling capacitances $C_{11}$ grounded in the electrical schematic diagram.

The two λ/4 resonators 250 and 251 should have the same dimensions so as to generate the same resonant frequency. If the two resonant frequencies are minutely different, it is possible to compensate this difference by providing an extremely narrow slit 253 in the metal layer 2501 on the top planar surface of the resonator as shown in FIG. 25. Excitation is performed on the lateral side walls of the resonator, but the dominant TEM mode current flows along the length of the resonator. Hence, this slit 253 should be formed to disturb the current flowing. This narrow slit 253 will induce a series inductance to the inductance component of the resonator resulting in the decrease of the resonant frequency.

The frequency-tuning slit may be provided in both the resonators 250 and 251, or in any one of them as this embodiment. Also, the frequency-tuning slit may be located at any position including a central section and a periphery of the top metal layer. Furthermore, the extension direction of the slit may be designed to any direction so long as it disturbs the dominant TEM mode current flowing. In addition, a plurality of slits may be provided.

Since the excitation electrodes 2504 and 2514 that are input/output ports are very close to each other in the bandpass filter of this embodiment, direct coupling will occur between these excitation electrodes. In general, the property of direct coupling (capacitive or inductive) depends upon the property of excitation (capacitive or inductive). As mentioned before, according to the measured characteristics of the bandpass filter of this embodiment, there are two attenuation poles at both sides of its passband.

In order to provide the two attenuation poles at both sides of the passband of the bandpass filter, it is necessary that the internal coupling and direct coupling have different property with each other. Namely, for example, one is capacitive and the other is inductive. This concept is described in, for example, Yoshihiro Konishi et al., "Design of Filter Circuit for Communication and Application thereof," Sogo Denshi Publishing Co., pp. 31–41, Feb. 1, 1994 (hereafter called as literature [4]).

In the bandpass filter of this embodiment, the internal coupling between two resonators is obtained through the open end surfaces where the electrical fields are at the maximum and the evanescent E-mode waveguide mainly holds capacitive energy. As a result, there is no possibility of occurring inductive internal coupling, and thus the internal coupling is capacitive.

Figure 32:
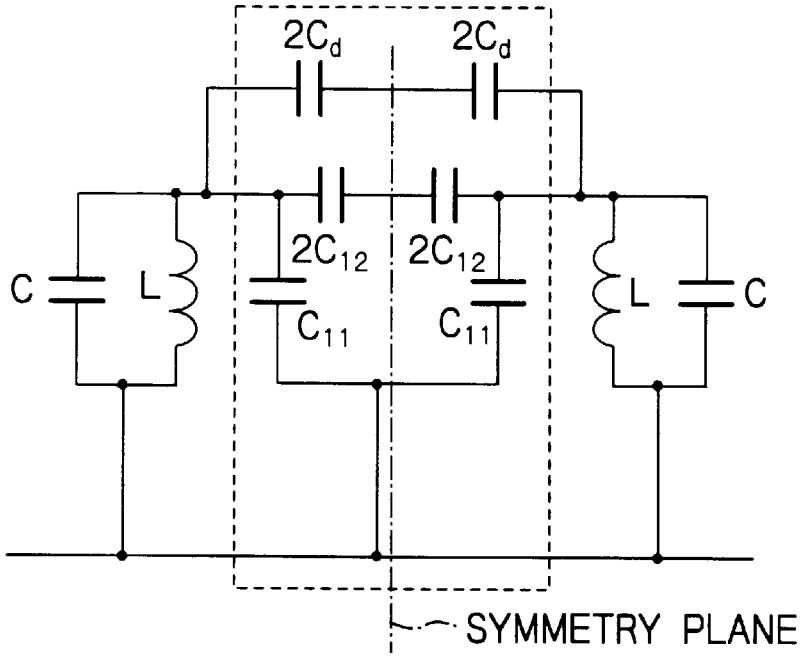
FIG. 32 is a circuit diagram illustrating an equivalent circuit for explaining an internal coupling of a bandpass filter in case of connecting capacitance $C_d$ in parallel.
Figure 33:
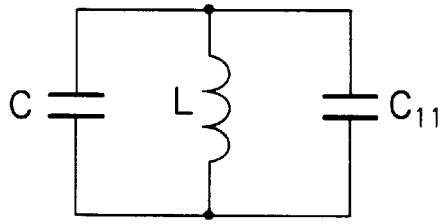
FIG. 33 is a circuit diagram illustrating an equivalent circuit of FIG. 32 in case of even-mode resonance.
Figure 34:
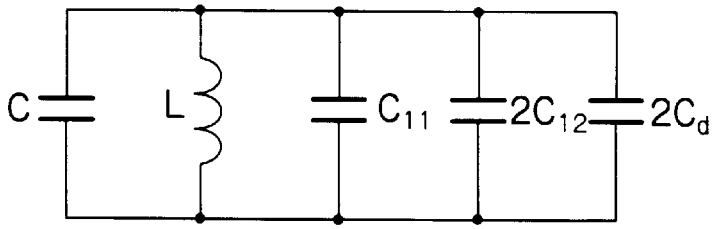
FIG. 34 is a circuit diagram illustrating an equivalent circuit of FIG. 32 in case of odd-mode resonance.

In case of the capacitive internal coupling, an even mode resonant frequency $f_{even}$ becomes higher than an odd mode resonant frequency $f_{odd}$. If a capacitance $C_d$ is connected to the internal coupling capacitance $C_{12}$ in parallel as shown in FIG. 32, the odd mode resonant frequency $f_{odd}$ will fall and the even mode resonant frequency $f_{even}$ will not change. Since the symmetry plane of the filter operates as an open circuit as shown in FIG. 33 in case of even mode resonance, the even mode resonant frequency $f_{even}$ is obtained from the following equation:

$$f_{even} = \frac{1}{2\pi\sqrt{L(C + C_{11})}},$$

and since the symmetry plane of the filter is short-circuited as shown in FIG. 34 in case of odd mode resonance, the odd mode resonant frequency $f_{odd}$ is obtained from the following equation:

$$f_{odd} = \frac{1}{2\pi\sqrt{L(C + C_{11} + 2C_{12} + 2C_d)}}.$$

Figure 35:
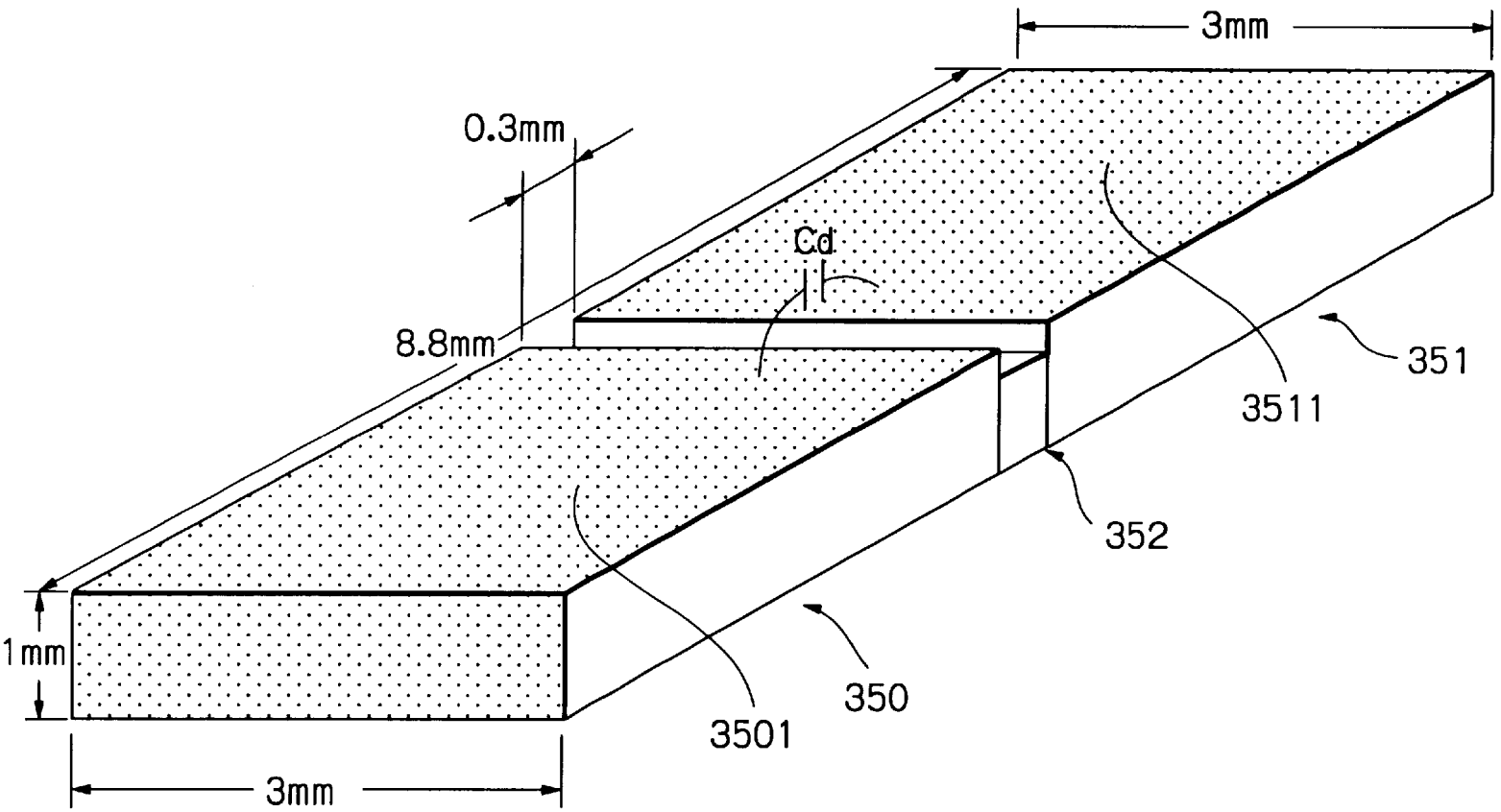
FIG. 35 is a perspective view for explaining the configuration for demonstrating capacitive internal coupling.
Figure 36:
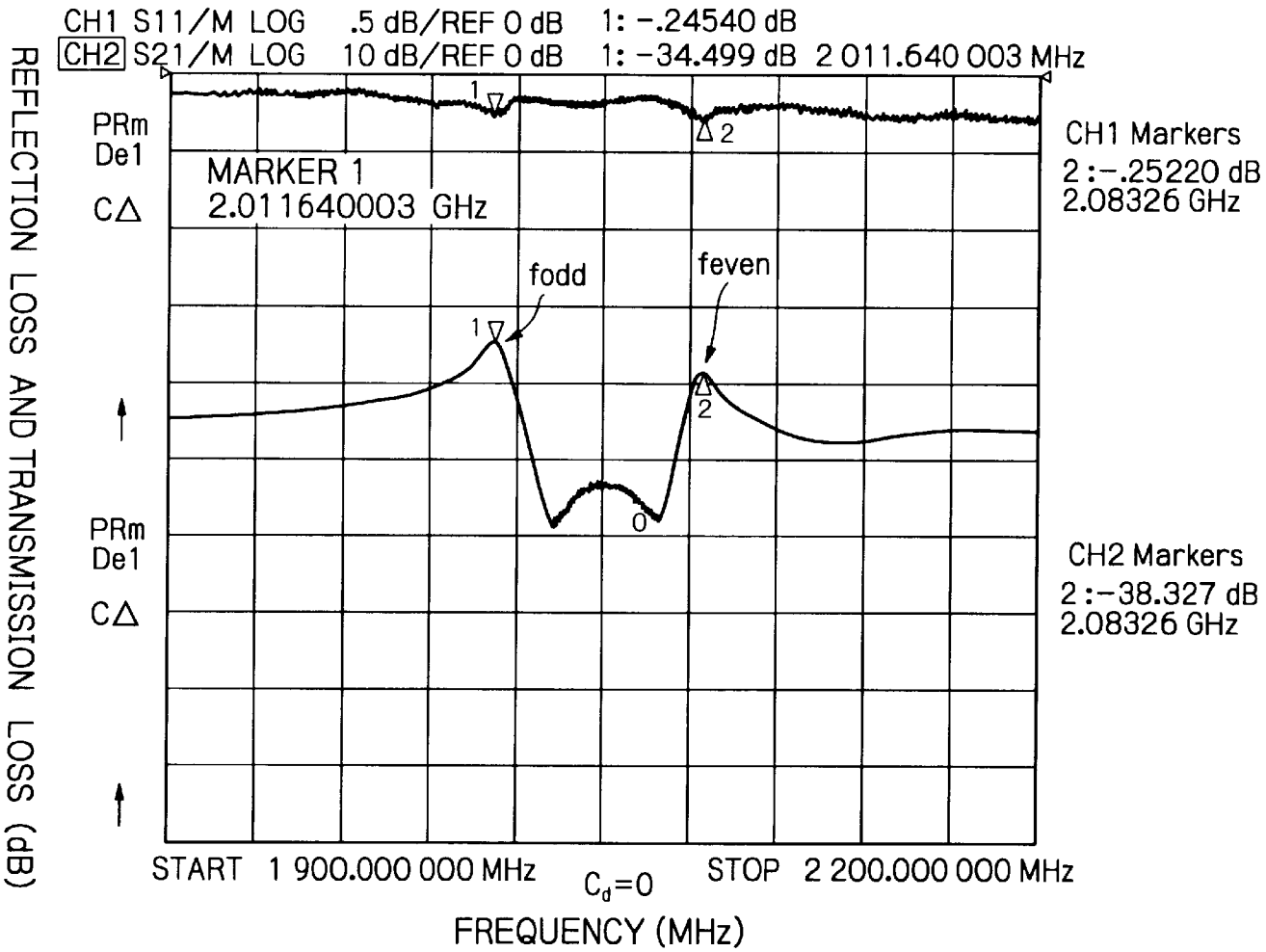
FIG. 36 is a graph illustrating the result of the measurement for demonstrating the capacitive internal coupling.
Figure 37:
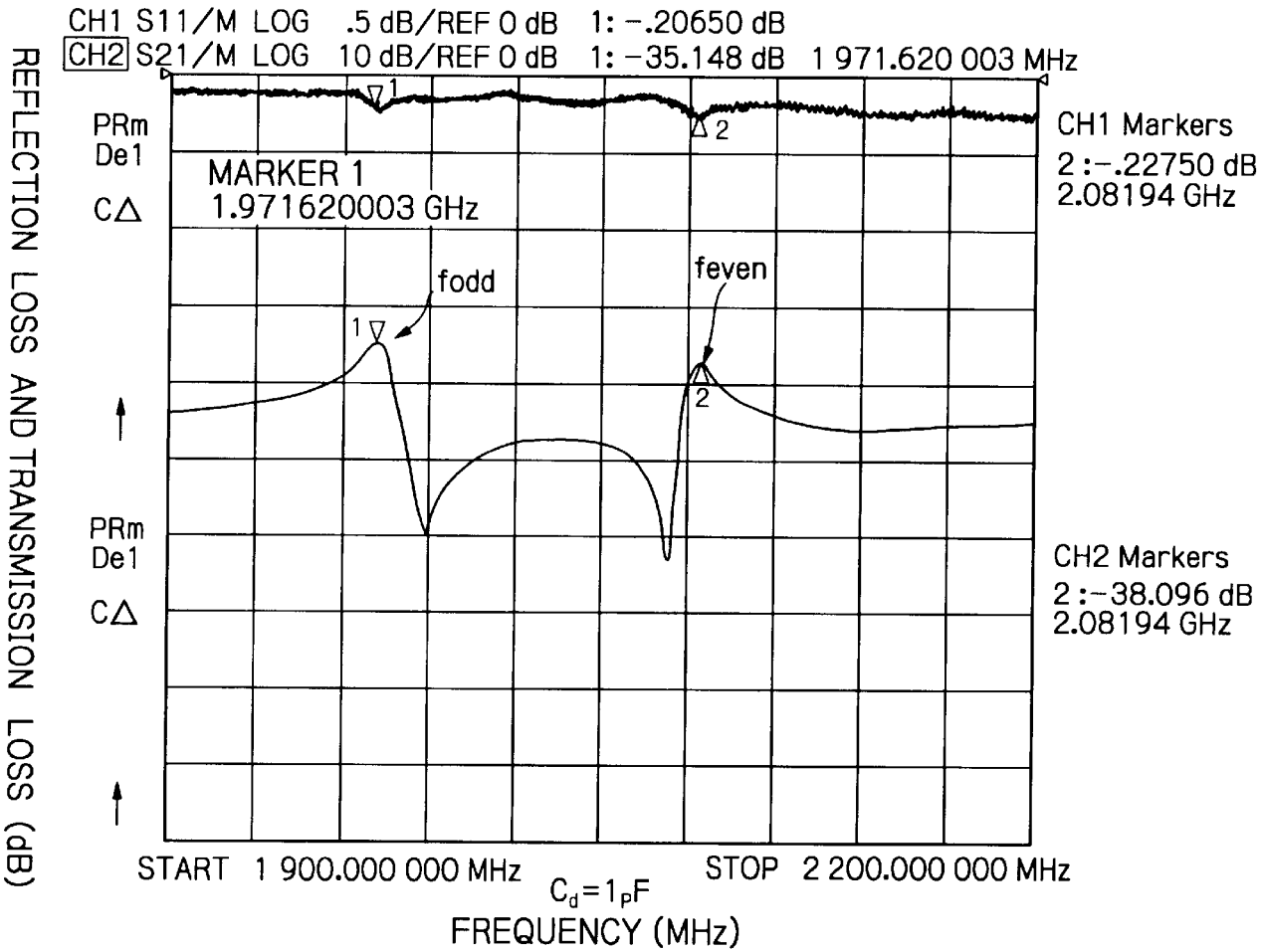
FIG. 37 is a graph illustrating the result of the measurement for demonstrating the capacitive internal coupling.

In order to experimentally verify this theoretical concept, even mode and odd mode resonant frequencies were measured as shown in FIG. 35 when a capacitance $C_d$ was connected and was not connected between metal layers 3501 and 3511 while input and output ports of a bandpass filter are in loose coupling. The metal layers 3501 and 3511 were formed on the respective top planar surfaces of two λ/4 resonators 350 and 351 connected via an evanescent E-mode waveguide 352. FIG. 36 illustrates the measurement result in case of $C_d$=0, and FIG. 37 the measurement result in case of $C_d$=1 pF, respectively. By comparing FIGS. 36 and 37, it will be understood that the odd mode resonant frequency $f_{odd}$ falls but the even mode resonant frequency $f_{even}$ hardly changes when the capacitance $C_d$ increases.

Thus, it is verified that the internal coupling has capacitive property.

It is known from literature [4] that if the direct coupling between input/output ports is capacitive in property, the frequency at each attenuation pole approaches a center frequency of the filter when this capacitance increases. On the contrary, if the direct coupling is inductive in property, the frequency at each attenuation pole goes away from the center frequency of the filter when this inductance increases. Furthermore, it is known from literature [4], if the direct coupling is a parallel combination of capacitance and inductance, the frequency at each attenuation pole goes away from the center frequency with the increase of the direct coupling capacitance and vice versa.

Figure 38:
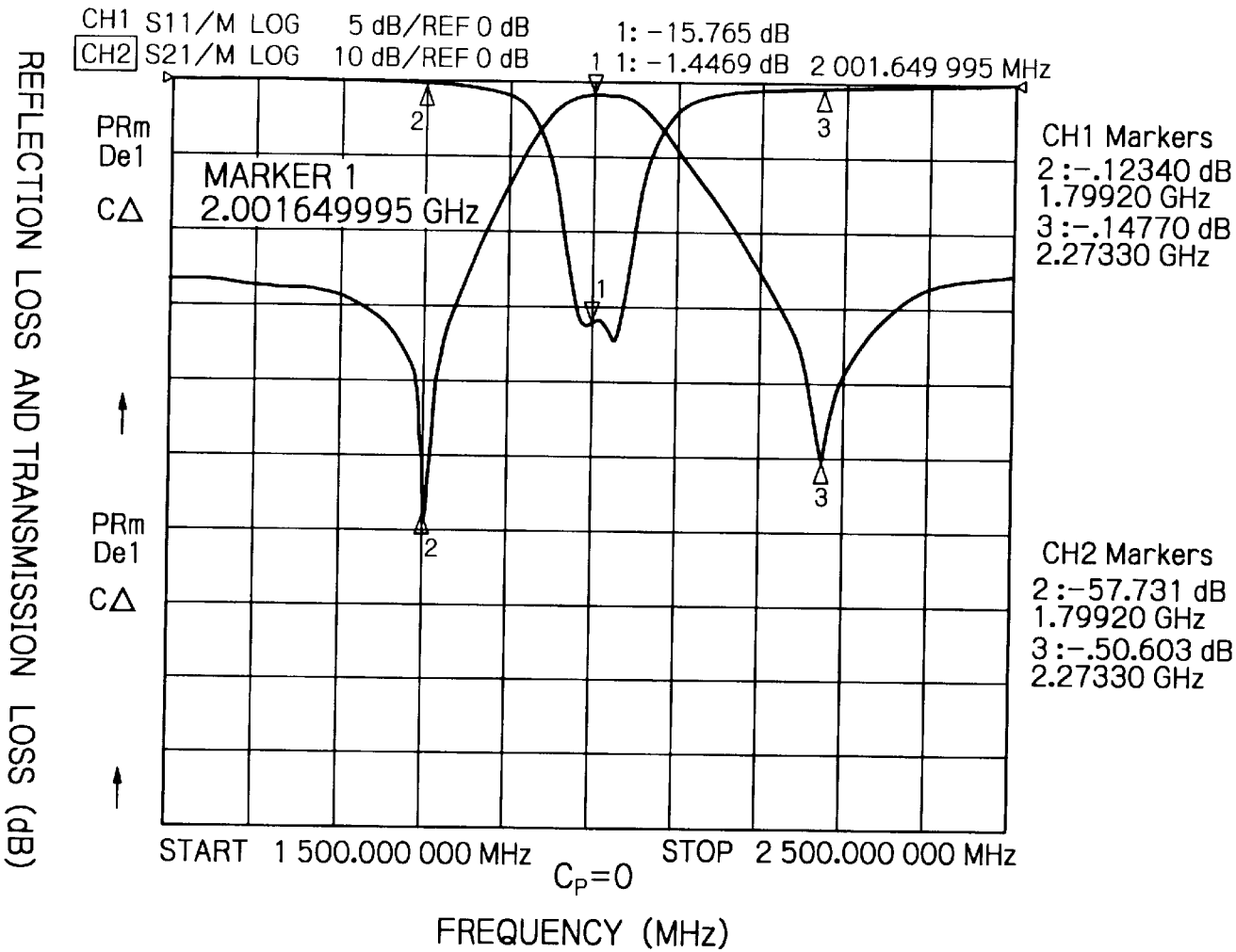
FIG. 38 is a graph illustrating the result of the measurement for demonstrating inductive direct coupling.

In order to experimentally verify the property of direct coupling between input/output ports, frequency characteristic s of the filter were actually measured when capacitance $C_p$ was not connected and was connected between the input/output ports. FIG. 38 illustrates the measurement result in case of $C_p$=0, and FIG. 39 the measurement result in case of $C_p$=0.5 pF, respectively. By comparing FIGS. 38 and 39, it will be understood that the frequency at each attenuation pole goes away from the center frequency of the filter when the direct coupling capacitance $C_p$ increases.

Thus, it is verified that the direct coupling has inductive property.

Figure 39:
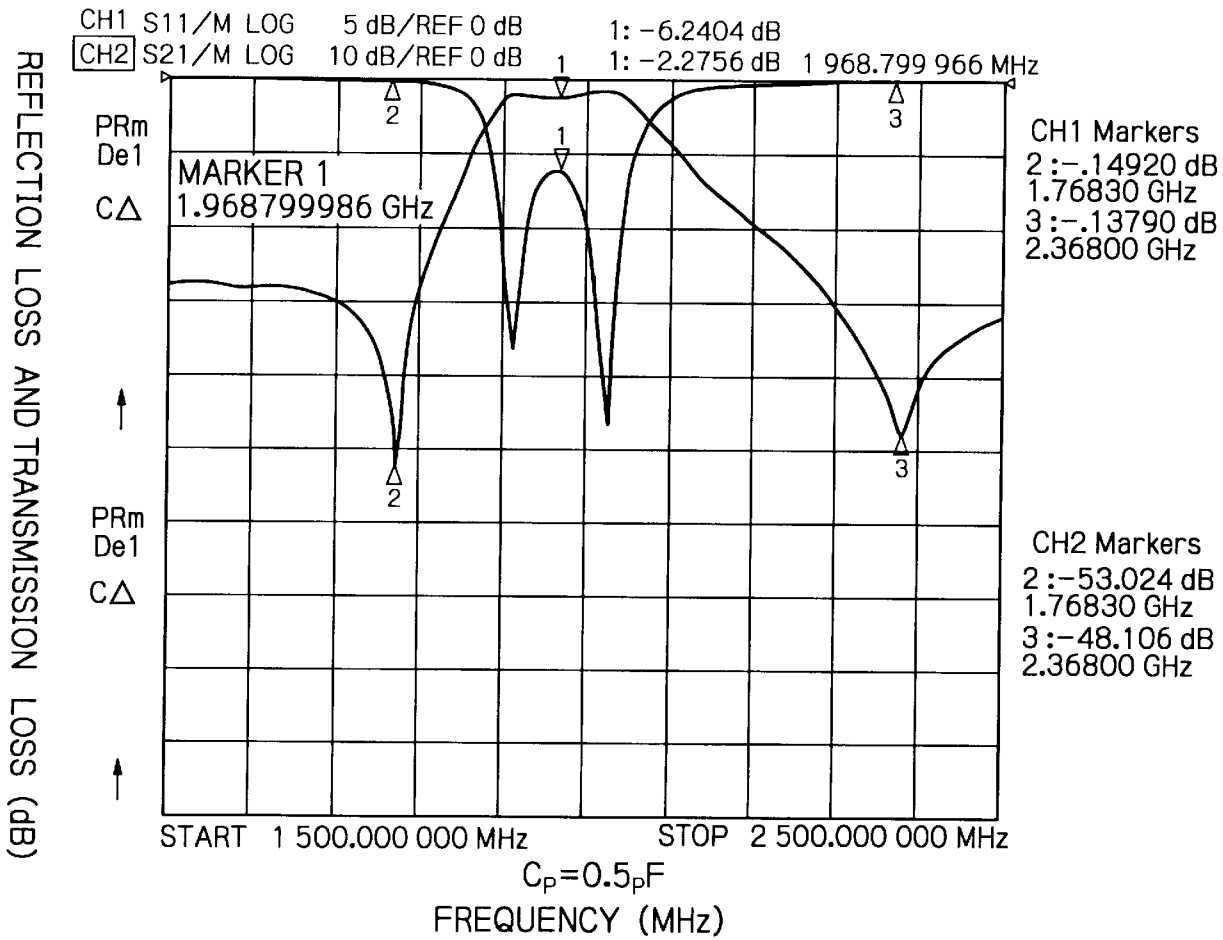
FIG. 39 is a graph illustrating the result of the measurement for demonstrating the inductive direct coupling.

Since the added capacitance $C_p$ connected between the input/output ports acts as a series capacitance with the excitation capacitance, the equivalent external circuit capacitance decreases. As shown in FIG. 39, coupling imbalance naturally occurs in this filter. Since the property of the added capacitance $C_p$ is contrary to that of the external circuit capacitance, these capacitances partially cancel each other. Thus, with the decrease of the effective excitation capacitance, the attenuation pole frequency approaches the center frequency of the filter.

The remarkably thin dielectric filter in this embodiment can provide drastic shrinkage of dimensions with maintaining its performance in comparison with the conventional dielectric waveguide filter. This TEM mode dielectric resonator filter can be applied to a mobile terminal in a wideband CDMA system, a wireless LAN and other various kinds of applications where signal processing is required.

In the filter of this embodiment, since the excitation and the internal coupling between two resonators are capacitive, it is possible to lower the resonant frequency of the filter and to further decrease the dimensions of the filter itself.

Sixth Embodiment of Dielectric Resonator Bandpass Filter

Figure 40:
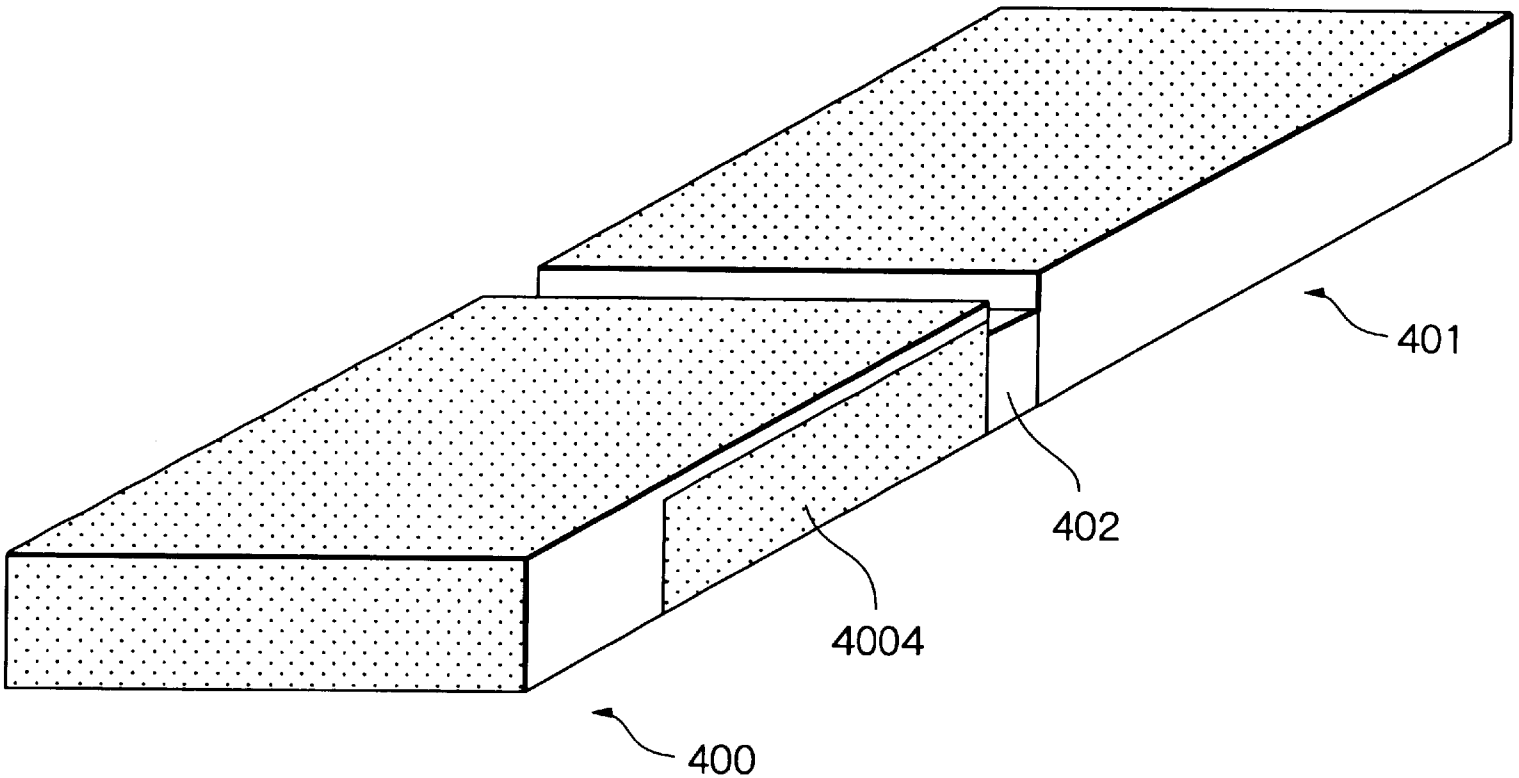
FIG. 40 is a perspective view schematically illustrating the configuration of a high frequency dielectric resonator bandpass filter with two dielectric resonators, as a sixth embodiment of the bandpass filter according to the present invention.

FIG. 40 schematically illustrates the configuration of a high frequency dielectric resonator bandpass filter with two dielectric resonators, as a sixth embodiment of the bandpass filter according to the present invention.

In the figure, reference numeral 400 denotes a first λ/4 dielectric resonator, and 401 a second λ/4 dielectric resonator, respectively. These two λ/4 resonators 400 and 401 are connected to each other via an evanescent E-mode waveguide 402.

This embodiment has the same configuration as the embodiment shown in FIG. 25 except that, in this embodiment, an excitation electrode 4004 of the λ/4 resonator 400 and an excitation electrode (not shown) of the λ/4 resonator 401 are formed on the right side walls with viewing the resonators from the shorted ends.

Other configuration, operations and advantages in this embodiment are the same as those in the embodiment in FIG. 25.

Seventh Embodiment of Dielectric Resonator Bandpass Filter

Figure 41:
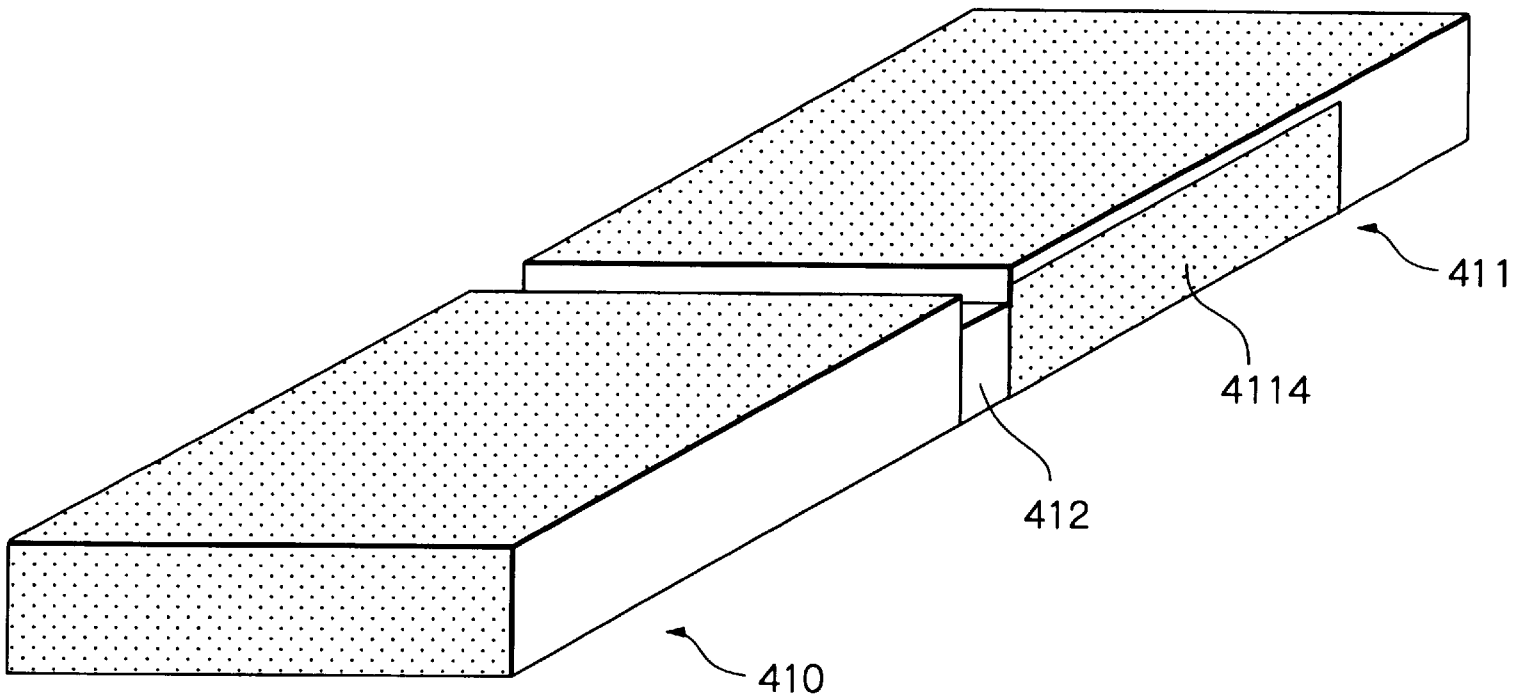
FIG. 41 is a perspective view schematically illustrating the configuration of a high frequency dielectric resonator bandpass filter with two dielectric resonators, as a seventh embodiment of the bandpass filter according to the present invention.

FIG. 41 schematically illustrates the configuration of a high frequency dielectric resonator bandpass filter with two dielectric resonators, as a seventh embodiment of the bandpass filter according to the present invention.

In the figure, reference numeral 410 denotes a first λ/4 dielectric resonator, and 411 a second λ/4 dielectric resonator, respectively. These two λ/4 resonators 410 and 411 are connected to each other via an evanescent E-mode waveguide 412.

This embodiment has the same configuration as the embodiment shown in FIG. 25 except that, in this embodiment, an excitation electrode (not shown) of the λ/4 resonator 410 and an excitation electrode 4114 of the λ/4 resonator 411 are formed on the left side walls with viewing the resonators from the shorted ends.

Other configuration, operations and advantages in this embodiment are the same as those in the embodiment in FIG. 25.

Eighth Embodiment of Dielectric Resonator Bandpass Filter

Figure 42:
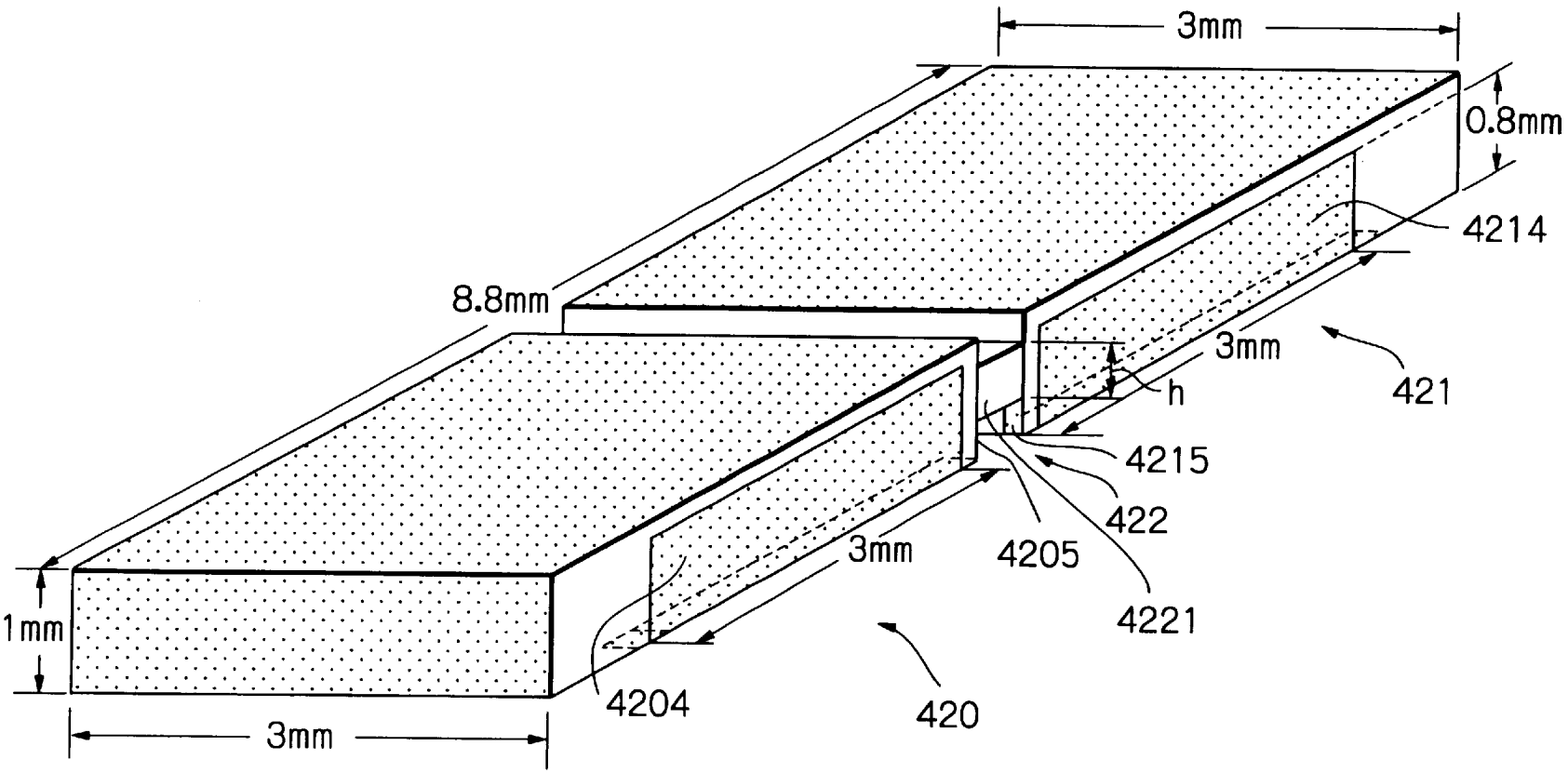
FIG. 42 is a perspective view schematically illustrating the configuration of a high frequency dielectric resonator bandpass filter with two dielectric resonators, as an eighth embodiment of the bandpass filter according to the present invention.

FIG. 42 schematically illustrates the configuration of a high frequency dielectric resonator bandpass filter with two dielectric resonators, as an eighth embodiment of the bandpass filter according to the present invention.

In the figure, reference numeral 420 denotes a first λ/4 dielectric resonator, and 421 a second λ/4 dielectric resonator, respectively. These two λ/4 resonators 420 and 421 are connected to each other via an evanescent E-mode waveguide 422.

In this embodiment, the evanescent E-mode waveguide 422 consists of a dielectric block having a rectangular planar shape, and only its two side surfaces that are not coupled with the resonators are coated with a metal layer (not shown) and a metal layer 4221, respectively. The metal layer 4221 is grounded via a conductor 4215 and a conductor 4205 (hidden in the figure) formed on side walls opposite to the respective shorted end surfaces of the λ/4 resonators 420 and 421. The other side of the λ/4 resonators 420 and 421, hidden in the figure has the same configuration. All of the top planar surface, the bottom planer surface and the remaining two side walls coupled to the resonators, of the dielectric waveguide 422 are open to the air.

Excitation electrodes 4204 and 4214 of the λ/4 resonators 420 and 421 are shifted so as not to contact with the metal layer 4221 of the waveguide 422.

Other configuration, operations and advantages in this embodiment are the same as those in the embodiment in FIG. 42.

Ninth Embodiment of Dielectric Resonator Bandpass Filter

Figure 43:
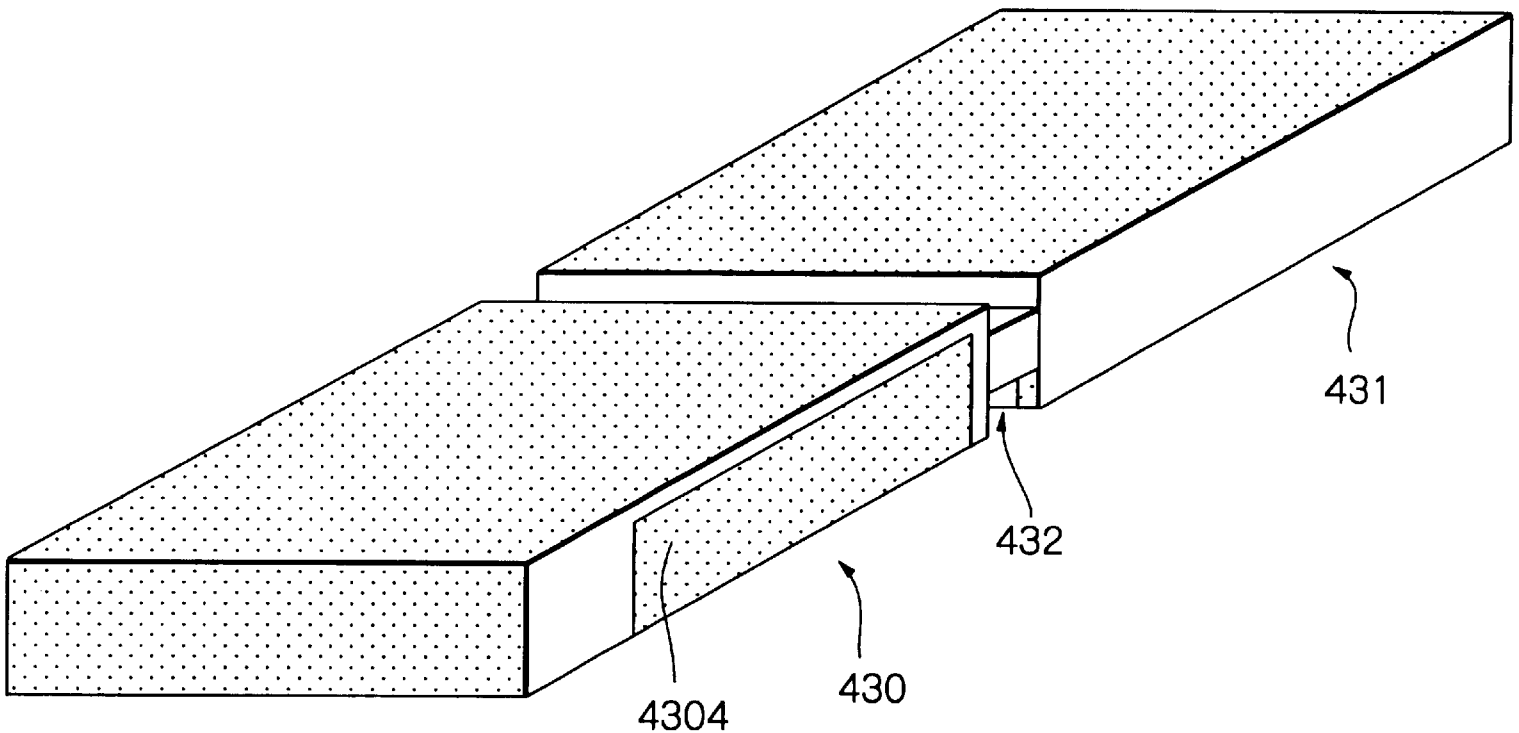
FIG. 43 is a perspective view schematically illustrating the configuration of a high frequency dielectric resonator bandpass filter with two dielectric resonators, as a ninth embodiment of the bandpass filter according to the present invention.

FIG. 43 schematically illustrates the configuration of a high frequency dielectric resonator bandpass filter with two dielectric resonators, as a ninth embodiment of the bandpass filter according to the present invention.

In the figure, reference numeral 430 denotes a first λ/4 dielectric resonator, and 431 a second λ/4 dielectric resonator, respectively. These two λ/4 resonators 430 and 431 are connected to each other via an evanescent E-mode waveguide 432.

This embodiment has the same configuration as the embodiment shown in FIG. 42 except that, in this embodiment, an excitation electrode 4304 of the λ/4 resonator 430 and an excitation electrode (not shown) of the λ/4 resonator 431 are formed on the right side walls with viewing the resonators from the shorted ends.

Other configuration, operations and advantages in this embodiment are the same as those in the embodiment in FIG. 42.

Tenth Embodiment of Dielectric Resonator Bandpass Filter

Figure 44:
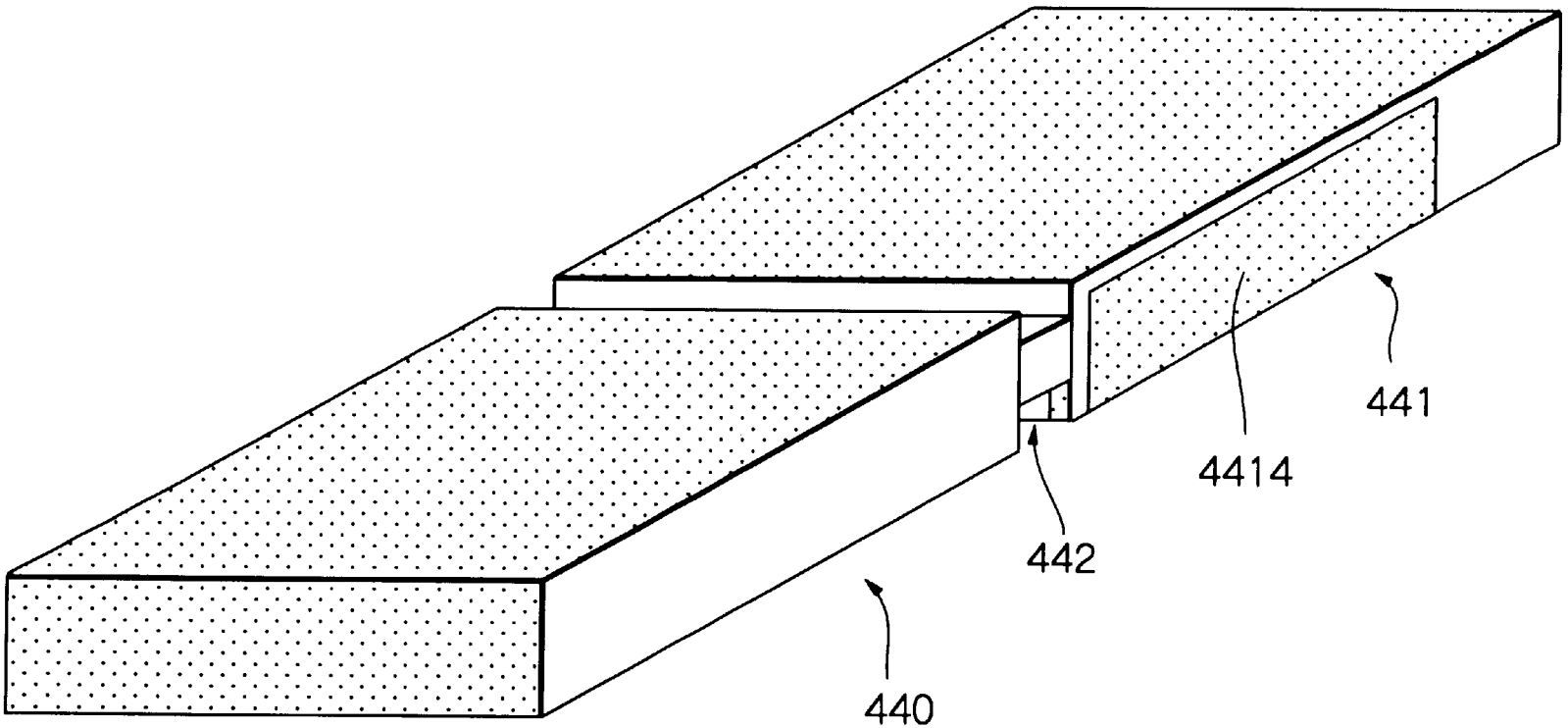
FIG. 44 is a perspective view schematically illustrating the configuration of a high frequency dielectric resonator bandpass filter with two dielectric resonators, as a tenth embodiment of the bandpass filter according to the present invention.

FIG. 44 schematically illustrates the configuration of a high frequency dielectric resonator bandpass filter with two dielectric resonators, as a tenth embodiment of the bandpass filter according to the present invention.

In the figure, reference numeral 440 denotes a first λ/4 dielectric resonator, and 441 a second λ/4 dielectric resonator, respectively. These two λ/4 resonators 440 and 441 are connected to each other via an evanescent E-mode waveguide 442.

This embodiment has the same configuration as the embodiment shown in FIG. 42 except that, in this embodiment, an excitation electrode (not shown) of the λ/4 resonator 440 and an excitation electrode 4414 of the λ/4 resonator 441 are formed on the left side walls with viewing the resonators from the shorted ends.

Other configuration, operations and advantages in this embodiment are the same as those in the embodiment in FIG. 42.

The configuration materials of the dielectric block, the evanescent E-mode waveguide and the metal layers in each of the aforementioned embodiments are merely examples, and it is apparent that the configuration materials are not limited to them. In addition, it is clear that the shape of the excitation electrode is not limited to an approximate rectangular shape, but any shape such as a square, a trapezoid or a circle may be used.

As described in detail, according to the present invention, since the resonator is constituted by a TEM mode λ/4 dielectric resonator with a rectangular dielectric block, a first metal layer coated on a top planar surface of the block, a second metal layer coated on a bottom planar surface of the block, and a third metal layer coated on one of four side surfaces of the block, a remarkable downsizing of the resonator can be expected without changing its resonant frequency and its unloaded quality factor.

Also, according to the present invention, since a two-pole bandpass filter is fabricated by using two TEM mode λ/4 dielectric resonators, downsizing and advanced performance can be expected.

Furthermore, according to the present invention, since the bandpass filter is fabricated so that attenuation poles occur at both sides of its passband, in other words, so that one of the direct coupling and the internal coupling between first and second resonators via the evanescent E-mode waveguide is a capacitive coupling and the other one is inductive coupling, it is possible to enhance the frequency characteristics outside the passband.

Many widely different embodiments of the present invention may be constructed without departing from the spirit and scope of the present invention. It should be understood that the present invention is not limited to the specific embodiments described in the specification, except as defined in the appended claims.

What is claimed is:

1. A TEM mode quarter wavelength dielectric resonator comprising:

a rectangular dielectric block having a top planar surface, a bottom planar surface and four side surfaces;

a first metal layer coated on said top planar surface; and a second metal layer coated on said bottom planar surface;

a third metal layer coated on one of said four side surfaces, wherein said first metal layer on the top planar surface has a narrow slit for frequency tuning.

2. The dielectric resonator as claimed in claim 1, said resonator further comprises a metal pattern partially formed on the one side surface that is different from said surface on which said third metal layer is coated.

3. The dielectric resonator as claimed in claim 1, wherein said slit is formed along a direction different from the mode propagation of said resonator.

4. A high-frequency filter using said TEM mode dielectric resonator claimed in claim 1.

5. A voltage controlled oscillator using said TEM mode dielectric resonator claimed in claim 1.

6. An antenna using said TEM mode dielectric resonator claimed in claim 1.

7. The dielectric resonator as claimed in claim 1, wherein said rectangular dielectric block is made of a ceramic dielectric material.

8. The dielectric resonator as claimed in claim 1, wherein said metal pattern is formed on the side surface opposite said side surface on which said third metal layer is coated.

9. The dielectric resonator as claimed in claim 1, wherein said metal pattern is an excitation electrode of said resonator.

10. The dielectric resonator as claimed in claim 1, wherein said metal pattern has dimensions suitable for external circuit coupling.

11. A dielectric resonator comprising:

a rectangular dielectric block having a top planar surface, a bottom planar surface and four side surfaces;

a first metal layer coated on said top planar surface;

a second metal layer coated on said bottom planar surface;

a third metal layer coated on one of said four side surfaces; and a metal pattern partially formed on the one side surface that is different from said side surface on which said third metal layer is coated, wherein said metal pattern has a substantially rectangular shape.

12. The dielectric resonator as claimed in claim 11, wherein said rectangular dielectric block is made of a ceramic dielectric material.

13. The dielectric resonator as claimed in claim 11, wherein said metal pattern is formed on the side surface opposite said side surface on which said third metal layer is coated.

14. The dielectric resonator as claimed in claim 11, wherein said metal pattern is an excitation electrode of said resonator.

15. The dielectric resonator as claimed in claim 11, wherein said metal pattern has dimensions suitable for external circuit coupling.

16. A high-frequency filter using said TEM mode dielectric resonator claimed in claim 11.

17. A voltage controlled oscillator using said TEM mode dielectric resonator claimed in claim 11.

18. An antenna using said TEM mode dielectric resonator claimed in claim 11.

19. A TEM mode quarter wavelength dielectric resonator comprising:

a rectangular dielectric block having a top planar surface, a bottom planar surface and four side surfaces;

a first metal layer coated on said top planar surface;

a second metal layer coated on said bottom planar surface;

a third metal layer coated on one of said four side surfaces; and a metal pattern partially formed on the one side surface that is different from said side surface on which said third metal layer is coated, wherein said metal pattern is isolated from said first metal layer coated on the top planar surface and from said second metal layer coated on the bottom planar surface.

20. The dielectric resonator as claimed in claim 19, wherein said rectangular dielectric block is made of a ceramic dielectric material.

21. The dielectric resonator as claimed in claim 19, wherein said metal pattern is formed on the side surface opposite said side surface on which said third metal layer is coated.

22. The dielectric resonator as claimed in claim 19, wherein said metal pattern is an excitation electrode of said resonator.

23. The dielectric resonator as claimed in claim 19, wherein said metal pattern has dimensions suitable for external circuit coupling.

24. A high-frequency filter using said TEM mode dielectric resonator claimed in claim 19.

25. A voltage controlled oscillator using said TEM mode dielectric resonator claimed in claim 19.

26. An antenna using said TEM mode dielectric resonator claimed in claim 19.

27. A TEM mode quarter wavelength dielectric resonator comprising:

a rectangular dielectric block having a top planar surface, a bottom planar surface and four side surfaces;

a first metal layer coated on said top planar surface;

a second metal layer coated on said bottom planar surface;

a third metal layer coated on one of said four side surfaces;

a metal pattern partially formed on the one side surface that is different from said side surface on which said third metal layer is coated; and an extension part extended from said metal pattern for control of external quality factor, said extension part being provided on said bottom planar surface.

28. The dielectric resonator as claimed in claim 27, wherein said rectangular dielectric block is made of a ceramic dielectric material.

29. The dielectric resonator as claimed in claim 27, wherein said metal pattern is formed on the side surface opposite said side surface on which said third metal layer is coated.

30. The dielectric resonator as claimed in claim 27, wherein said metal pattern is an excitation electrode of said resonator.

31. The dielectric resonator as claimed in claim 27, wherein said metal pattern has dimensions suitable for external circuit coupling.

32. A high-frequency filter using said TEM mode dielectric resonator claimed in claim 27.

33. A voltage controlled oscillator using said TEM mode dielectric resonator claimed in claim 27.

34. An antenna using said TEM mode dielectric resonator claimed in claim 27.

35. A bandpass filter using a TEM mode dielectric resonator, comprising:

first and second dielectric resonators each including a dielectric block having a top planar surface, a bottom planar surface, and four side surfaces; and an evanescent H-mode waveguide coupling section, each of said first and second dielectric resonators having first and second metal layers coated on said top planar surface and said bottom planar surface, respectively, and a third metal layer coated on one of said four side surfaces, said side surface on which said third metal layer is coated being a shorted end surface and the remaining side surfaces being open to the air so that each of said first and second dielectric resonators acts as a quarter wavelength dielectric resonator and keeps an independent TEM mode of electromagnetic field, said evanescent H-mode waveguide coupling section providing TEM mode coupling between said first and second dielectric resonators by connecting said shorted end surfaces of the respective first and second dielectric resonators so as to act in an evanescent mode with a cutoff frequency higher than each resonant frequency of said first and second dielectric resonators.

36. The bandpass filter as claimed in claim 35, wherein said first and second dielectric resonators are made of the same dielectric material.

37. The bandpass filter as claimed in claim 35, wherein said first and second dielectric resonators are made of ceramic dielectric material with a high dielectric constant.

38. The bandpass filter as claimed in claim 35, wherein said first and second dielectric resonators have the almost same dimensions.

39. The bandpass filter as claimed in claim 35, wherein said evanescent H-mode waveguide coupling section has a shorter length and a smaller cross section than these of each of said first and second dielectric resonators.

40. The bandpass filter as claimed in claim 39, wherein dimensions of said evanescent H-mode waveguide coupling section are selected so as to obtain a desired coupling between said first and second dielectric resonators.

41. The bandpass filter as claimed in claim 35, wherein said evanescent mode waveguide coupling section has a rectangular cross section.

42. The bandpass filter as claimed in claim 35, wherein said evanescent mode waveguide coupling section is made of the same dielectric material with said first and second dielectric resonators.

43. The bandpass filter as claimed in claim 35, wherein said evanescent H-mode waveguide coupling section provides series coupling inductance and a pair of shunt coupling inductances between said first and second dielectric resonators.

44. The bandpass filter as claimed in claim 35, wherein said second metal layer coated on each of the bottom planar surfaces of said first and the second dielectric resonators is used as a ground plane.

45. The bandpass filter as claimed in claim 44, wherein said ground plane is extended to the two open side surfaces in each of said first and second dielectric resonators.

46. The bandpass filter as claimed in claim 35, wherein the side surface opposite to said shorted end surface of each of said first and second dielectric resonators has an electrical input/output port.

47. The bandpass filter as claimed in claim 46, wherein said electrical input/output port is a metal pattern with a rectangular, square, trapezoidal or circular shape.

48. The bandpass filter as claimed in claim 47, wherein said metal pattern is isolated from said first metal layer coated on the top planar surface and from said second metal layer coated on the bottom planar surface.

* * * * *